US010520871B2

(12) United States Patent
Matsumoto

(10) Patent No.: US 10,520,871 B2
(45) Date of Patent: Dec. 31, 2019

(54) IMAGE FORMING APPARATUS THAT CHANGES NIP PRESSURE BASED ON SHEET CHARACTERISTICS

(71) Applicant: CANON KABUSHIKI KAISHA, Tokyo (JP)

(72) Inventor: Shogo Matsumoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 15/814,164

(22) Filed: Nov. 15, 2017

(65) Prior Publication Data

US 2018/0148291 A1 May 31, 2018

(30) Foreign Application Priority Data

Nov. 30, 2016 (JP) ..... 2016-233352

(51) Int. Cl.

| | |
|---|---|
| ***G03G 15/00*** | (2006.01) |
| ***G03G 15/20*** | (2006.01) |
| ***B65H 7/06*** | (2006.01) |
| ***B65H 5/06*** | (2006.01) |

(52) U.S. Cl.

CPC ..... *G03G 15/5029* (2013.01); *B65H 5/062* (2013.01); *B65H 7/06* (2013.01); *G03G 15/2028* (2013.01); *G03G 15/6511* (2013.01); *G03G 15/6576* (2013.01); *B65H 2301/51256* (2013.01); *B65H 2404/14* (2013.01); *B65H 2511/416* (2013.01); *B65H 2515/34* (2013.01); *B65H 2801/27* (2013.01)

(58) Field of Classification Search

CPC ..... G03G 15/6576; G03G 15/5029
See application file for complete search history.

(56) References Cited

U.S. PATENT DOCUMENTS 8,433,235 B2 * 4/2013 Hase ..... G03G 15/6576 399/406

FOREIGN PATENT DOCUMENTS

| | | | |
|---|---|---|---|
| JP | 6-3900 | A | 1/1994 |
| JP | 6-144679 | A | 5/1994 |
| JP | 6-258906 | A | 9/1994 |
| JP | 2000-177907 | A | 6/2000 |
| JP | 2011145543 | A | 7/2011 |

* cited by examiner

*Primary Examiner* — Justin N Olamit
(74) *Attorney, Agent, or Firm* — Canon U.S.A., Inc. IP Division

(57) ABSTRACT

An image forming apparatus includes a plate, a feeding unit that feeds a recording material placed on the plate, an image forming unit that form an image on the fed recording material, a conveying unit to convey a recording material pinched by a nip pressure from a rotating member nip portion, a switching unit to switch the nip pressure, a detecting unit, and a control unit. The detecting unit detects property information regarding the fed recording material. In response to an instruction to form the image on the recording material and before detection of property information completes, the control unit controls to switch the nip pressure based on information regarding image forming on the recording material, and after detection of the property information completes, the control unit controls to switch the nip pressure based on the information regarding the image forming on the recording material and the detected property information.

19 Claims, 14 Drawing Sheets

IMAGE FORMING APPARATUS THAT CHANGES NIP PRESSURE BASED ON SHEET CHARACTERISTICS

BACKGROUND OF THE INVENTION

Field of the Invention

The present disclosure relates to an image forming apparatus including a curl correction mechanism configured to correct a curl on a recording material and a fixing unit configured to fix an image onto a recording material.

Description of the Related Art

Conventionally, some image forming apparatuses such as a copier and a printer may have a curl correction mechanism configured to correct a curl on a recording material formed when passing through a fixing unit. The curl correction mechanism has a nip portion formed by members such as rollers or a belt and applies pressure to a curled recording material at the nip portion while conveying the recording material.

Japanese Patent Laid-Open No. 6-258906 discloses an arrangement configured to adjust nip pressure to be generated by a curl correction mechanism and to be applied to a curled recording material based on a printing ratio of an image formed on the recording material. In order to form a full-color image on a recording material, the printing ration of all colors (Y, M, C, K) are calculated, and the adjustment of nip pressure is then started. This, however, may take long time until completion of the nip pressure adjustment. Conveyance of a recording material to the curl correction mechanism before the nip pressure adjustment completes can be prevented by setting to delay feeding of a recording material from a feeding port of a cassette, for example. This may result in a longer first print output time (FPOT) that is a time period from a time when an image forming instruction is given to a time when the first recording material on which an image is formed is discharged to outside of the main body of the image forming apparatus.

According to Japanese Patent Laid-Open No. 6-258906, a way to address this issue is that the printing ration of three colors (Y, M, C) are calculated, and the printing ratio of the remaining one color (K) is estimated from information regarding the printing ration of the three colors. Thus, the nip pressure adjustment can be started before the calculation of the printing ration of all colors completes. Thus, the nip pressure adjustment can complete earlier than the configuration which calculates the printing ration of all colors, and the recording material can be fed earlier. Therefore, an increase of the FPOT can be prevented.

A curl formed on a recording material may vary in accordance with not only the printing ration but also the type of a recording material (plain paper, thick paper, or thin paper) and the ambient temperature and humidity. Among them, the type of a recording material can automatically be discriminated by detecting property information such as a surface condition, a thickness, and a basis weight of the recording material. Such property information can be obtained by a paper type detecting sensor such as an optical sensor or an ultrasonic sensor provided in a conveying path. The paper type detecting sensor may be provided at each of feeding ports of a plurality of cassettes, which however increases the cost. Therefore, in many cases, a paper type detecting sensor may be provided at a position following a position where conveying paths from the feeding ports join.

A recording material conveying path having a reduced length for reduction of the size of an image forming apparatus may reduce the space between the paper type detecting sensor and the curl correction mechanism. In this configuration, after detection by the paper type detecting sensor completes, the nip pressure adjustment by the curl correction mechanism may start. In this case, when the nip pressure adjustment based on a result of detection of property information regarding a recording material takes time, the recording material may reach the curl correction mechanism before the nip pressure adjustment completes. In order to prevent this, the recording material may need to reach the curl correction mechanism in delayed timing by, for example, reducing the conveying speed of the recording material or temporarily stopping the recording material in the conveying path. This also results in an increased FPOT.

It is also configured such that the nip pressure can be changed not only in the curl correction mechanism but also in the fixing unit configured to fix an image to a recording material. Changing the nip pressure in the fixing unit based on the type of a recording material and an ambient temperature and humidity may improve quality of an image fixed onto the recording material. However, also in the fixing unit, like the curl correction mechanism, when the nip pressure adjustment starts after completion of detection by the paper type detecting sensor, the recording material may reach the fixing unit before the nip pressure adjustment completes.

SUMMARY OF THE INVENTION

The disclosed image forming apparatus works towards preventing a first print output time (FPOT) from increasing in a configuration which changes the nip pressure in a conveying unit configured to convey a recording material such as a curl correction mechanism and a fixing unit based on a detection result provided by a paper type detecting sensor provided in a conveying path.

According to an aspect of the present invention, an image forming apparatus includes a plate configured to receive a recording material placed on the plate, a feeding unit configured to feed a recording material placed on the plate, an image forming unit configured to form an image on the recording material fed by the feeding unit, a conveying unit including a first rotating member and a second rotating member, wherein the conveying unit is configured to convey the recording material on which the image has been formed by the image forming unit and is pinched by a nip pressure from a nip portion formed by the first rotating member and the second rotating member, a switching unit configured to switch the nip pressure in at least three levels, a detecting unit provided between the feeding unit and the conveying unit and configured to detect property information regarding the recording material fed by the feeding unit, and a control unit configured to control the switching unit, wherein, in response to an instruction to form the image on the recording material and before detection of property information regarding the recording material by the detecting unit completes, the control unit is configured to control the switching unit to switch the nip pressure based on information regarding image forming on the recording material, and wherein, in response to the instruction to form the image on the recording material and after detection of the property information regarding the recording material by the detecting unit completes, the control unit is configured to control the switching unit to switch the nip pressure based on the information regarding the image forming on the recording material and the property information detected by the detecting unit.

Further features of the present invention will become apparent from the following description of embodiments with reference to the attached drawings.

DESCRIPTION OF THE EMBODIMENTS

First Embodiment

General Configuration of Image Forming Apparatus

Figure 1A:
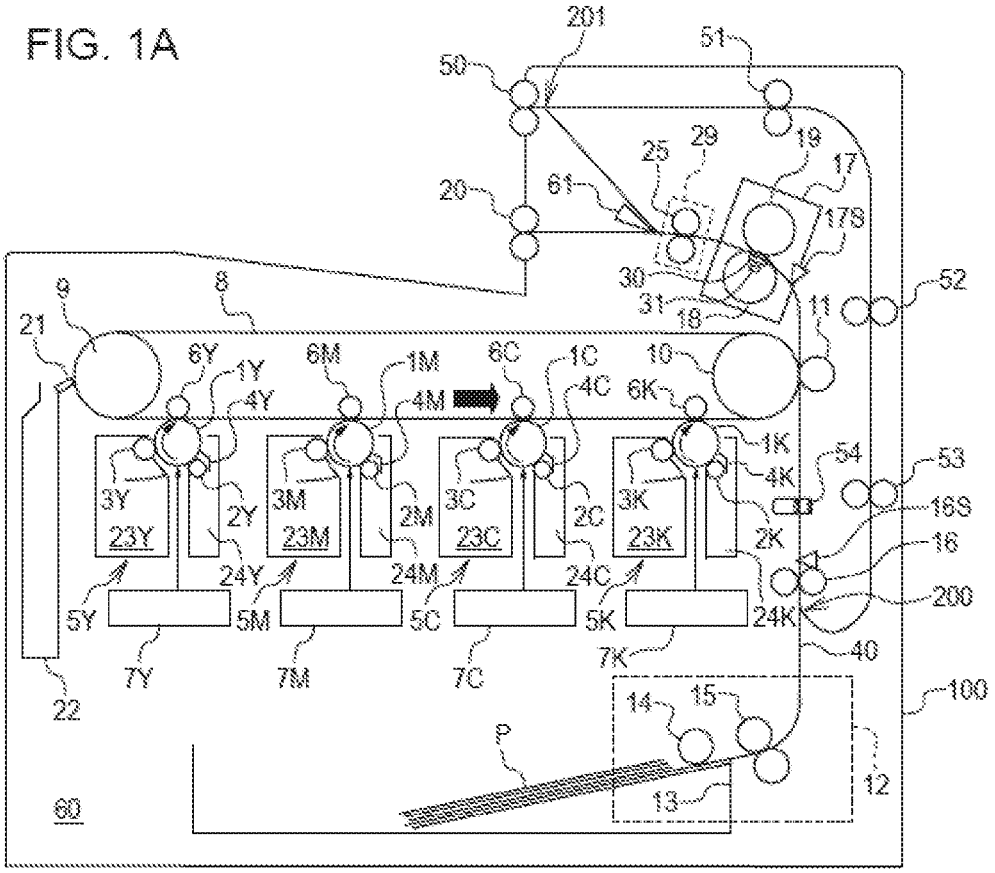
FIGS. 1A to 1C are schematic diagrams illustrating a general configuration of an image forming apparatus.

With reference to FIG. 1A, a general configuration of an image forming apparatus according to a first embodiment will be described. According to this embodiment, the image forming apparatus may be a laser beam printer, for example.

A laser beam printer 100 (hereinafter, called a printer 100) has process cartridges 5Y, 5M, 5C, and 5K. The process cartridges 5Y, 5M, 5C, and 5K are detachably attached to a main body of the printer 100. The four process cartridges 5Y, 5M, 5C, and 5K have an identical structure but are different in that they apply toners (developing agents) of different colors, that is, yellow (Y), magenta (M), cyan (C), and black (K) to form an image. References Y, M, C, and K are omitted in the following descriptions except for descriptions regarding a member corresponding to a specific color.

Each of the process cartridges 5 has a toner container 23, a photoconductive drum 1, a charging roller 2, a developing roller 3, a cleaning blade 4, and a waste toner container 24. Exposure devices 7 are disposed below the process cartridges 5 and are configured to expose the photoconductive drums 1 based on an image signal.

The photoconductive drums 1 are evenly charged to a predetermined polarity and potential by a corresponding charging roller 2 while the photoconductive drums 1 are rotating. The photoconductive drums 1 undergo image exposure by the exposure devices 7 so that electrostatic latent images corresponding to target polychrome images can be formed.

The exposure devices 7 applied according to this embodiment are polygon scanners having laser diodes and bring laser beams modulated based on image information onto the photoconductive drums 1 to form electrostatic latent images. The electrostatic latent images formed on the photoconductive drums 1 are developed by developing rollers 3. Toners of the colors are adhered to the electrostatic latent images on the photoconductive drums 1 through the developing rollers 3 to develop toner images. The toners in the toner containers 23 are negatively charged nonmagnetic single-component toners, and electrostatic latent images are developed by a contact developing method with the nonmagnetic single-component toners.

An intermediate transfer belt unit includes an intermediate transfer belt 8 (image bearing member), a driving roller 9, and an opposing roller for secondary-transfer 10. Primary transfer rollers 6 are placed inside the intermediate transfer belt 8 by facing the photoconductive drums 1 and are configured to receive a primary transfer bias of positive polarity from a primary transfer bias power supply, not illustrated. A motor, not illustrated, rotates the driving roller 9 so that the intermediate transfer belt 8 rotates, which is followed by rotation of the opposing roller for secondary-transfer 10. The photoconductive drums 1 rotate in directions indicated by arrows illustrated nearby in FIG. 1A, and the intermediate transfer belt 8 rotates in a direction indicated by an arrow illustrated nearby in FIG. 1A. A primary transfer bias with a positive polarity is applied to the primary transfer rollers 6. Thus, toner images on the photoconductive drums 1 undergo primary transfer to the intermediate transfer belt 8 in order from the toner image on the photoconductive drum 1Y. After that, the stacked toner images of four colors are conveyed to a secondary transfer roller 11.

The cleaning blades 4 for the photoconductive drums 1 are in pressure contact with the photoconductive drums 1 to remove residual toners left on surfaces of the photoconductive drum 1 without being transferred to the intermediate transfer belt 8 and other residual substances on the photoconductive drums 1. A partial visible image may remain on the intermediate transfer belt 8 without being transferred to paper P at the position of the secondary transfer roller 11. Such a visible image left on the belt is removed by a cleaning operation using a cleaning blade 21 and is collected to a waste toner container 22.

A feeding/conveying device 12 has a feeding roller 14 (feeding unit) configured to feed paper P from a cassette 13 (plate) storing paper P (recording materials) and a conveyance roller pair 15 configured to convey paper P fed thereto. Paper P conveyed from the feeding/conveying device 12 is conveyed to a registration roller pair 16 along a conveyance guide 40 and is conveyed to the secondary transfer roller 11 by the registration roller pair 16. A bias of a positive polarity is applied to the secondary transfer roller 11 so that the toner images of four colors on the intermediate transfer belt 8 are transferred to the conveyed paper P (hereinafter, called secondary transfer).

A paper type detecting sensor 54 is placed on a downstream side of the registration roller pair 16 in the conveying direction for paper P and on an upstream side of the secondary transfer roller 11. The paper type detecting sensor 54 is a sensor configured to detect property information of paper P conveyed thereto. When property information regarding paper P is to be detected by the paper type detecting sensor 54 according to this embodiment, the conveyance of the paper P is stopped. Particularly, a feeding motor, not illustrated, is stopped from a time when the leading edge of paper P is detected by the registration sensor 16S to a time when the leading edge of the paper P certainly reaches the position of the paper type detecting sensor 54. The paper type detecting sensor 54 will be described below in detail.

The paper P after toner images are transferred thereto is conveyed to a fixing device 17. The fixing device 17 is a film heating fixing unit including a fixing film 18 containing a heater 30 and a temperature sensor 31 configured to measure a temperature of the heater 30 and a pressurizing roller 19 for pressure contact with the fixing film 18. A fixing/discharge sensor 17S is configured to detect reach of paper P to the fixing device 17. The fixing device 17 is configured to heat and press paper P to fix toner images transferred to the paper P to the paper P. When toner images are fixed to the paper P, the paper P may curl. In the configuration according to this embodiment, paper P may curl in a direction of winding around the pressurizing roller 19. The paper P to which toner images are fixed is conveyed by a decurling roller pair 25 in a curl correction mechanism 29 and is discharged by a discharge roller pair 20 to outside of the printer 100. The curl correction mechanism 29 is a mechanism configured to correct a curl formed on paper P and can correct the curl by applying force to the paper P in the opposite direction of the direction that the paper P is winding around the pressurizing roller 19. The curl correction mechanism 29 will be described below in detail.

When paper P having passed through the fixing device 17 is not discharged to undergone printing on a second surface of the paper P, the paper P having passed through the fixing device 17 is conveyed toward a reverse point 201. A double-sided flapper 61 can switch the conveying direction for paper P between a discharging direction and an inverting direction. After paper P passes through the reverse point 201, the paper P is conveyed by a reverse roller pair 50 in a direction for discharging paper to outside. When the trailing edge of paper P passes through the reverse point 201 and the reverse roller pair 50 nips the paper P, the reverse roller pair 50 is stopped once. The reverse roller pair 50 is then rotated in the opposite direction of the direction of conveyance up to this point so that the paper P can be conveyed toward a double-sided conveying path.

Within the double-sided conveying path, paper P is conveyed by a first double-sided conveying roller pair 51, a second double-sided conveying roller pair 52, and a third double-sided conveying roller pair 53. At a junction 200, the double-sided conveying path joins a conveyance guide 40 arranged between the conveyance roller pair 15 and the registration roller pair 16. The reversed paper P is conveyed again to the secondary transfer roller 11 by the registration roller pair 16. Toner images of four colors on the intermediate transfer belt 8 are transferred to the second surface of the paper P. The fixing device 17 fixes the toner images transferred to the second surface. The double-sided flapper 61 is switched to the discharging direction so that the double-sided printed paper P is discharged to outside of the printer 100.

The printer 100 has an environmental sensor 60 configured to detect an ambient temperature and humidity of the printer 100.

Discrimination of Paper Type

Figure 1B:
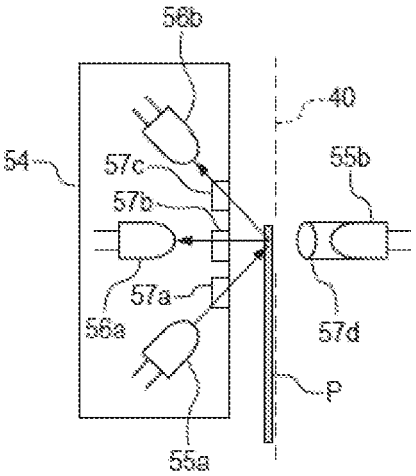

FIG. 1B illustrates a detail configuration of the paper type detecting sensor 54 according to this embodiment. The paper type detecting sensor 54 has an LED 55*a*, an LED 55*b*, a phototransistor 56*a*, and a phototransistor 56*b*.

Light emitted from the LED 55*a* is irradiated to a surface of paper P on the conveyance guide 40 through a slit 57*a*. The conveyance guide 40 has a window for irradiating light to a back surface of paper P. The reflected light from the paper P is gathered through slits 57*b* and 57*c* and is received by the phototransistors 56*a* and 56*b*. The phototransistor 56*a* receives diffused reflected light of light emitted from the LED 55*a*, and the phototransistor 56*b* receives specular reflected light thereof. A value based on the amount of diffused reflected light received by the phototransistor 56*a* is output to the discrimination control unit 113, and a value based on the amount of specular reflected light received by the phototransistor 56*b* is output to the discrimination control unit 113. Thus, a CPU 104 obtains a gloss (x=specular reflection output/diffused reflection output). In other words, a surface property of the paper P can be detected as property information regarding the paper P. Light emitted from the LED 55*b* is irradiated to a back surface of the paper P through a condensing guide 57*d* configured to collect light. The transmitted light through the paper P is received by a phototransistor 56*a* through a slit 57*b*. The phototransistor 56*a* receives transmitted light of light emitted from the LED 55*b*. A value based on the amount of transmitted light received by the phototransistor 56*a* is output to the discrimination control unit 113. Then, the CPU 104 obtains a transmittance (y=output from the phototransistor 56*a*). In other words, the thickness of the paper P can be detected as property information regarding the paper P.

Figure 1C:
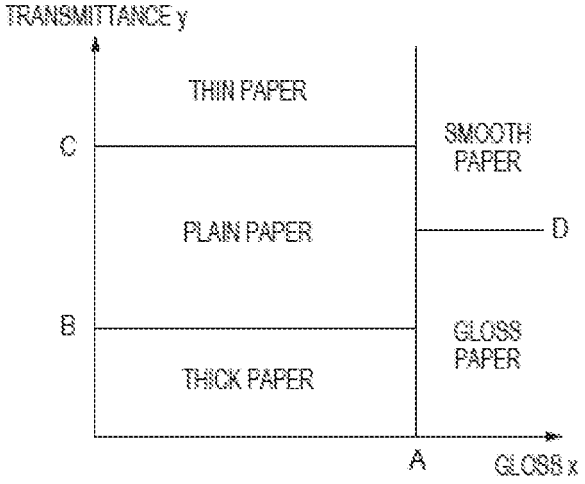

The printer 100 discriminates the paper type based on the gloss and transmittance of the paper P obtained by detection of the paper P performed by the paper type detecting sensor 54. According to this embodiment, referring to FIG. 1C, five paper types (plain paper, thin paper, thick paper, gloss paper, and smooth paper) may be discriminated. With reference to FIG. 1C, a case will first be described in which the gloss x is lower than a threshold value A. If the transmittance y is lower than a threshold value B, the printer 100 discriminates thick paper as the paper type of the paper P. If the transmittance y is higher than the threshold value B and is lower than a threshold value C, the printer 100 discriminates plain paper as the paper type of the paper P. If the transmittance y is higher than the threshold value C, the printer 100 discriminates thin paper as the paper type of the paper P. Next, a case will be described in which the gloss x is higher than the threshold value A. If the transmittance y is lower than a threshold value D, the printer 100 discriminates gloss paper as the paper type of the paper P. If the transmittance y is higher than the threshold value D, the printer 100 discriminates smooth paper as the paper type of the paper P. Thus, by detection of paper P performed by the paper type detecting sensor 54, the paper type of the paper P can be discriminated. The threshold values A to D may be stored in a non-volatile memory 114 illustrated in FIG. 2.

According to this embodiment, the LED 55*a* is arranged to irradiate LED light to a surface of paper P diagonally at a predetermined angle as illustrated in FIG. 1B. The LED 55*b* is arranged to irradiate LED light to the paper P from a front position of the phototransistor 56*a* as illustrated in FIG. 1B.

General Control Over Image Forming Apparatus

Figure 2:
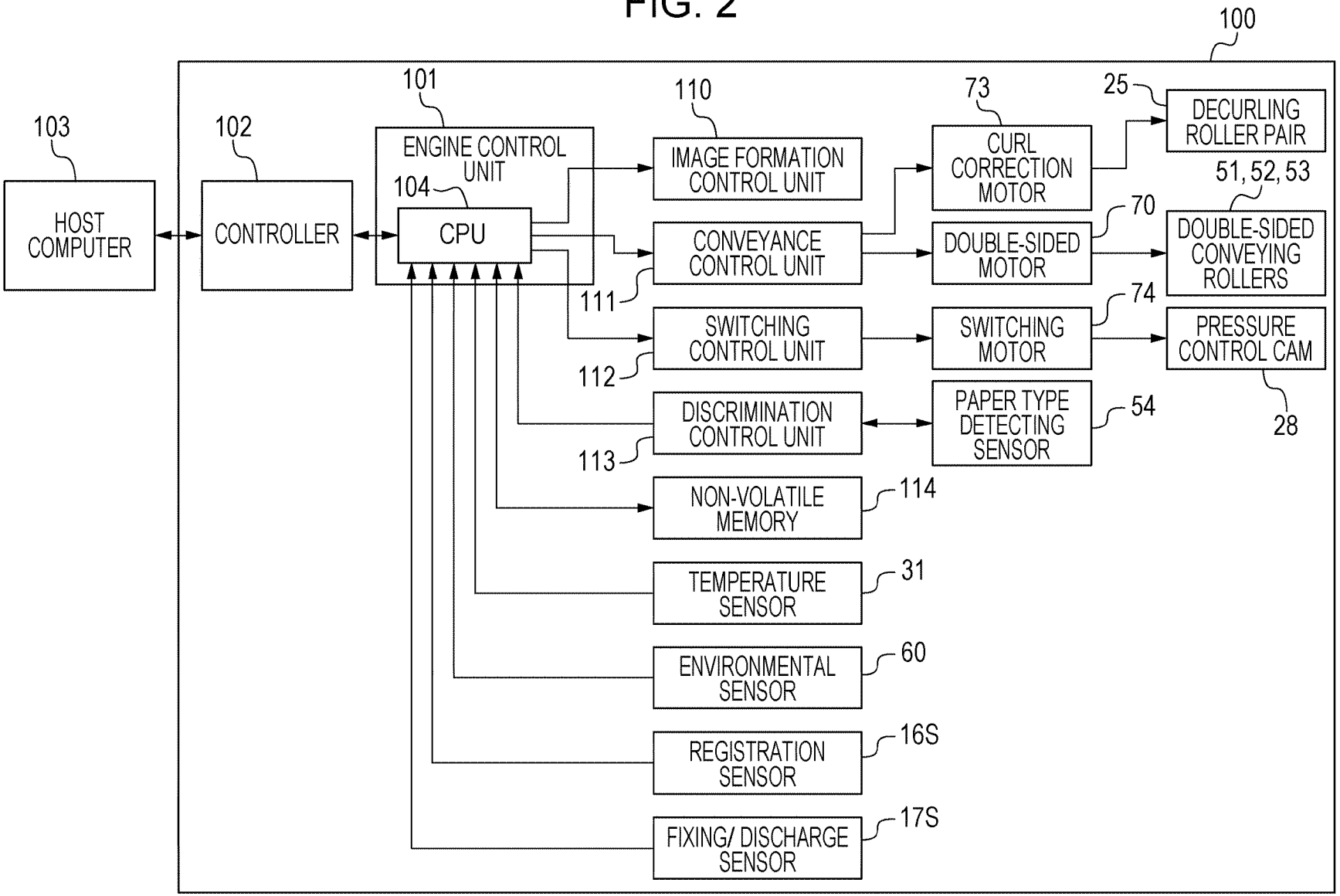
FIG. 2 illustrates control blocks in the image forming apparatus.

FIG. 2 is a control block diagram according to this embodiment. The printer 100 has a controller 102 and an engine control unit 101. The controller 102 is connected to a host computer 103 over a network or via a printer cable, for example, and gives a print instruction to the engine control unit 101 based on settings in the host computer 103. The engine control unit 101 includes a circuit having the CPU 104 and a ROM and a RAM, not illustrated, and is configured to execute a program for controlling devices within the printer 100.

The CPU 104 is connected to an image forming control unit 110 configured to control a charging bias, for example, and a conveyance control unit 111 configured to drive motors for rotating pairs of rollers on a conveying path and may instruct them to form an image on paper P and convey the paper P. The CPU 104 is further connected to a switching control unit 112, a discrimination control unit 113, and a non-volatile memory 114. The switching control unit 112 is configured to switch the nip pressure of the decurling roller pair 25. The discrimination control unit 113 is configured to discriminate the paper type of paper P based on a detection result from the paper type detecting sensor 54. The CPU 104 is further connected to a temperature sensor 31, an environmental sensor 60, a registration sensor 16S, and a fixing/discharge sensor 17S and can obtain results detected by the sensors.

When the conveyance control unit 111 drives the curl correction motor 73, the decurling roller pair 25 rotates along the conveying direction of paper P. Driving the conveyance control unit 111 drives a double-sided motor 70 rotate the first double-sided conveying roller pair 51, the second double-sided conveying roller pair 52, and the third double-sided conveying roller pair 53. When the switching control unit 112 drives a switching motor 74, a pressure control cam 28, which will be described below, rotates so that the nip pressure of the decurling roller pair 25 is changed.

The discrimination control unit 113 discriminates a paper type of the paper P detected by the paper type detecting sensor 54 with reference to a paper type discrimination table as illustrated in FIG. 1C based on the gloss and transmittance of paper P. The gloss of the paper P is detected based on an output value with light emitted from the LED 55*a*, and the transmittance of the paper P is detected based on an output value with light emitted from the LED 55*b*. Therefore, the gloss and transmittance of the paper P are detected not simultaneously but sequentially such as detecting the gloss first and next detecting the transmittance.

Next, control processing to be performed for executing a printing operation will be described. First, the controller 102 transmits a print reservation command to the engine control unit 101 based on a print instruction given from the host computer 103. The engine control unit 101 starts a preparation operation for performing a printing operation in order of reception of print reservation commands from the controller 102 and waits for a print start command transmitted from the controller 102. When the preparation operation completes and the printer 100 gets ready for printing, the controller 102 transmits a print start command to the engine control unit 101. In response to the print start command, the engine control unit 101 outputs a /TOP signal being reference timing for output of a video signal to the controller 102 and starts a printing operation based on the print reservation command.

The print reservation command may designate information regarding a paper type, a paper feeding port, and the size of paper P. When the print reservation command designates a specific paper type such as plain paper or thick paper, the engine control unit 101 determines image forming conditions such as a target temperature for a corresponding fixing temperature adjustment and the nip pressure of the decurling roller pair 25 and performs a printing operation under the conditions. When the print reservation command does not designate a specific paper type but designates automatic discrimination mode, the discrimination control unit 113 automatically discriminates the paper type of the paper P, and the engine control unit 101 performs a printing operation under the image forming conditions based on the discriminated paper type. In the automatic discrimination mode, image forming conditions are not determined until the paper type discrimination completes. Therefore, the engine control unit 101 is to output the /TOP signal after the paper type discrimination completes.

Curl Correction Mechanism

Figure 3A:
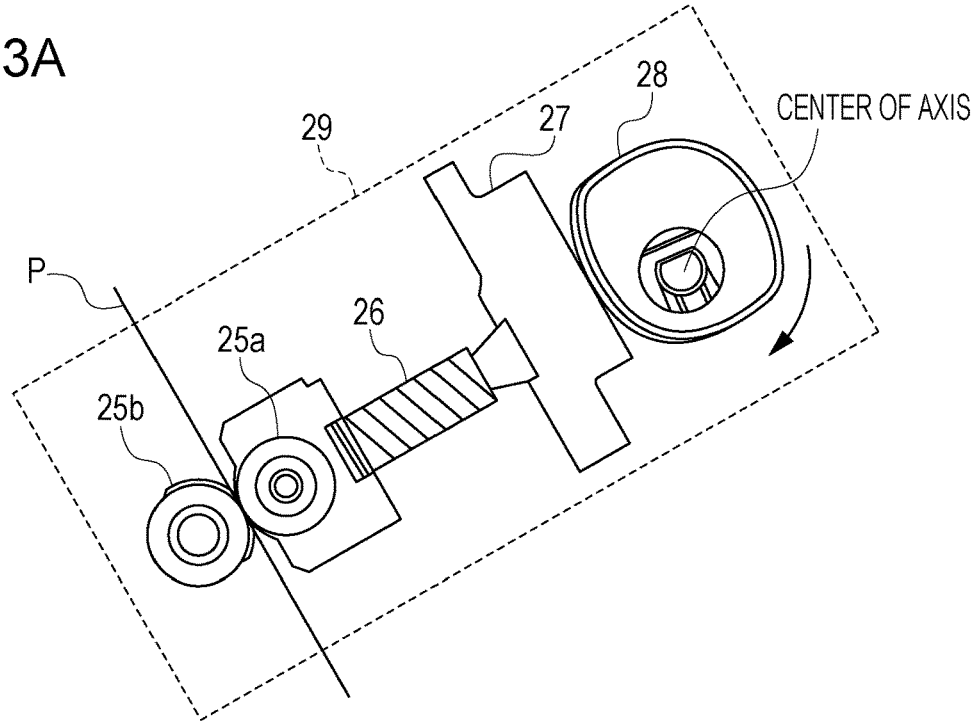
FIGS. 3A and 3B are schematic diagrams illustrating a configuration of a curl correction mechanism.

FIG. 3A illustrates a configuration of the curl correction mechanism 29. The decurling roller pair 25 includes a curl correction roller 25*a* (first rotating member) and a curl correction opposed roller 25*b* (second rotating member). The curl correction roller 25*a* is made of silicone rubber foam having an Asker C hardness of about 30, and the curl correction opposed roller 25*b* is made of iron. The curl correction roller 25*a* having a lower hardness presses the curl correction opposed roller 25*b* having a higher hardness to form a nip portion along an outer periphery of the curl correction opposed roller 25*b*. The paper P is pinched by the nip portion to be conveyed so that a curl formed on the paper P by the fixing film 18 and pressurizing roller 19 can be corrected toward the opposite direction. In other words, the paper P is nipped along the outer periphery of the curl correction opposed roller 25*b* so that a curl formed in a direction of winding around the pressurizing roller 19 can be corrected. When the switching control unit 112 drives the switching motor 74, the pressure control cam 28 rotates in a direction indicated by an arrow in FIG. 3A. The rotation stop position of the pressure control cam 28 may be changed to switch the pressure that the curl correction roller 25*a* applies to the curl correction opposed roller 25*b* through a pressure lever 27 and a pressurizing spring 26.

Figure 3B:
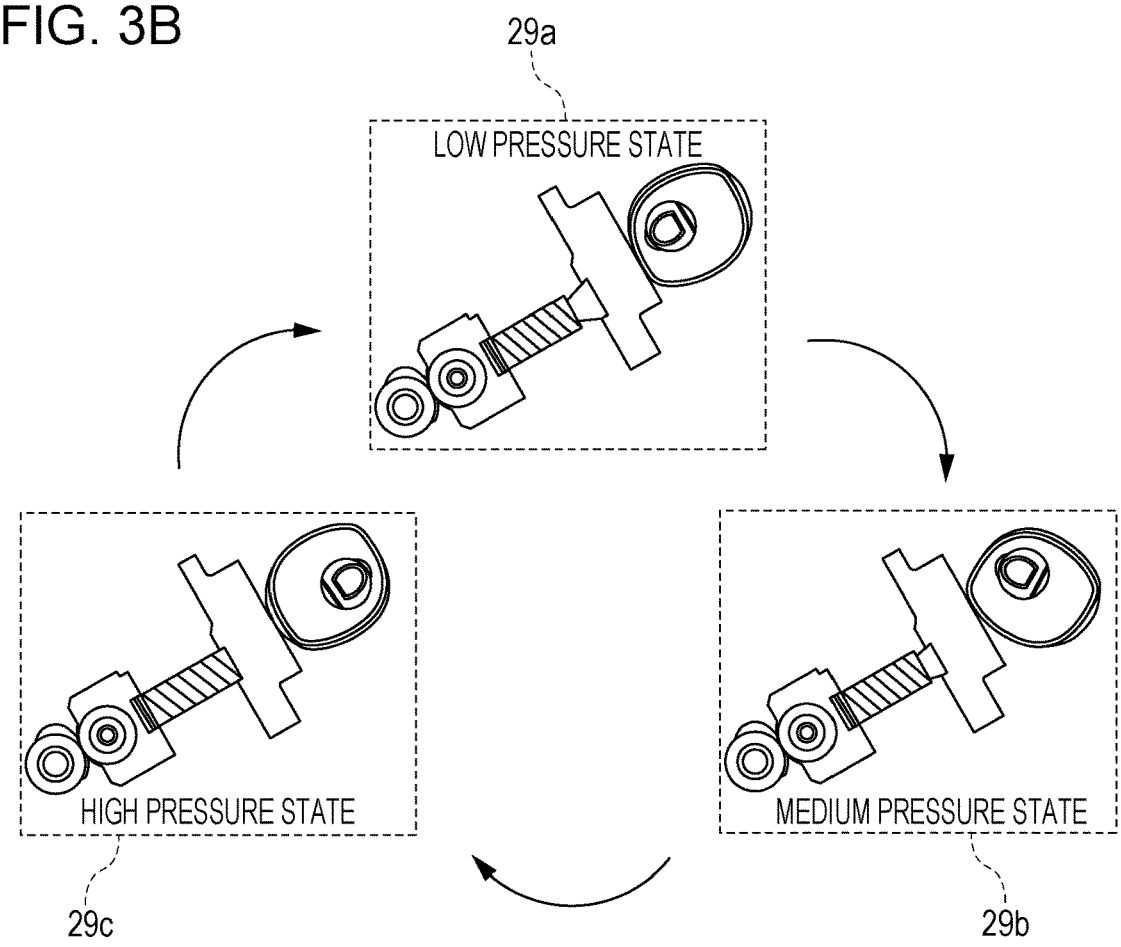

FIG. 3B illustrates three states with different nip pressures of the decurling roller pair 25. In a low pressure state 29*a*, the decurling roller pair 25 has a lowest nip pressure. A medium pressure state 29*b* may be obtained by rotating the pressure control cam 28 by 72° in clockwise from the low pressure state 29*a*. Here, the nip pressure of the decurling roller pair 25 is higher than that in the low pressure state 29*a*. A high pressure state 29*c* may be obtained by rotating the pressure control cam 28 by 110° in clockwise from the medium pressure state 29*b*. Here, the nip pressure of the decurling roller pair 25 is higher than that in the medium pressure state 29*b*. When the pressure control cam 28 in the high pressure state 29*c* rotates by 178° in clockwise, the pressure state 29*a* is obtained. These three curl correction states (states of the nip pressure of the decurling roller pair 25) can be changed only in one direction along the direction indicated by the arrows illustrated in FIG. 3B.

When a leading edge of paper P enters to the decurling roller pair 25 while the curl correction state (nip pressure) is changing, there is a possibility that a paper jam (paper jam) will occur. This is caused by instable directions of movement of the entering paper P after passing through the decurling roller pair 25 due to the instable nip pressure of the decurling roller pair 25 and thus variations of the conveying path of the leading edge of the paper P. Accordingly, the operation for switching the curl correction state is paused before the paper P enters to the nip according to this embodiment. Here, a predetermined margin time occurs before the switching control unit 112 stops the switching motor 74 and the switching of the curl correction state is actually stopped. According to this embodiment, the switching of the curl correction state is discontinued when the leading edge of paper P reaches a first position upstream of the decurling roller pair 25. The first position in consideration of such a margin time may be a position 10 mm upstream of the decurling roller pair 25, for example.

The paper P can be conveyed in a stable manner after the switching of the curl correction state is discontinued and the leading edge of the paper P reaches a second position downstream of the decurling roller pair 25. The second position for stable conveyance of paper P may be a position 50 mm downstream of the decurling roller pair 25, for example. According to this embodiment, during a period from a time when the leading edge of paper P reaches a position 10 mm upstream of the decurling roller pair 25 to a time when it reaches a position 50 mm downstream of the decurling roller pair 25, the switching of the curl correction state is temporarily discontinued.

Curl Correction Control

Next, curl correction control will be described. According to this embodiment, curl correction states are determined from the following four viewpoints. In order to switch the curl correction state, the switching motor 74 is driven, and the pressure control cam 28 is rotated by a desired phase angle from the number of driving steps of the switching motor 74. Here, the switching motor 74 may be a stepping motor.

A first viewpoint may be an amount of moisture (hereinafter, absolute moisture content) in ambient air of the printer 100. When the ambient temperature or humidity of the printer 100 is low and the absolute moisture content is low, paper P contains a low amount of moisture, which means a small curl may be formed on the paper P. When the absolute moisture content is high on the other hand, paper P contains a higher amount of moisture, which means that a large curl may be formed on the paper P. Accordingly, the nip pressure for correcting the curl is to be switched based on the size of the formed cur depending on the absolute moisture content. The absolute moisture content can be detected by the environmental sensor 60.

A second viewpoint may be a temperature of the fixing device 17 when a printing operation starts (hereinafter, a fixing temperature). Here, the term "fixing temperature" refers to a temperature of the heater 30 before the temperature increases with a printing operation. In a case where a printing operation starts at a high fixing temperature after a short period of time passed from the last printing operation, a fixing operation is started with a small temperature difference between the fixing film 18 and the pressurizing roller 19. Therefore, a small curl is formed on paper P. This state is called a Hot state. On the other hand, in a case where a printing operation starts at a fixing temperature reduced to a substantially normal temperature after a long period of time passed from the last printing operation, a fixing operation is performed with a large temperature difference between the fixing film 18 and the pressurizing roller 19. Therefore, a large curl is formed on paper P. This state is called a Cold state. Accordingly, the nip pressure for correcting a curl is to be changed based on the size of the formed curl depending on the temperature of the fixing device 17. A Hot state or a Cold state may be discriminated by the CPU 104 by comparing the temperature of the heater 30 detected by the temperature sensor 31 and a threshold temperature prestored in the non-volatile memory 114. In other words, when the detected temperature of the heater 30 is higher than the threshold temperature, the CPU 104 discriminates a Hot state. If the detected temperature of the heater 30 is lower than the threshold temperature, the CPU 104 discriminates a Cold state.

A third viewpoint is printing side information indicating simplex print or duplex print. When duplex print processing is performed, the degree of a curl formed during a printing operation performed on the first side is reduced during a printing operation performed on the second side. Thus, the degree of the curl formed on paper P is smaller than the resulting degree of a curl formed in simplex print processing. This is because a curl is formed during the second side printing in the opposite direction of the direction of the curl formed during the first side printing so that the curl formed during the first side printing can be cancelled. Accordingly, the nip pressure for correcting a curl is to be changed based on the size of the formed curl depending on the type of printing, simplex print and duplex print, to be executed. The printing side information is contained in a print reservation command transmitted from the controller 102.

A fourth viewpoint is a paper type of paper P on which printing is to be performed. Comparing thin paper having low stiffness and thick paper having high stiffness, higher nip pressure may be needed to correct a curl on the thick paper than that for correcting a curl on the thin paper where the degrees of curls on the thick paper and the thin paper are substantially equal. Correcting a curl on thin paper with high nip pressure may possibly result in formation of a curl in the opposite direction of the direction in which the original curl has been formed. In a case where paper type information is contained in a print reservation command transmitted from the controller 102, the discrimination control unit 113 may discriminate a paper type based on property information detected by the paper type detecting sensor 54.

Thus, according to this embodiment, a curl correction state is determined based on information regarding those four viewpoints by using a nip pressure selection table on Table 1. Referring to Table 1, when an absolute moisture content is equal to or higher than 20 [g/m$^3$], the absolute moisture content is handled as "High". When an absolute moisture content is equal to or higher than 5 [g/m$^3$] and lower than 20 [g/m$^3$], the absolute moisture content is handled as "Medium". When an absolute moisture content is lower than 5 [g/m$^3$], the absolute moisture content is handled as "Low". Further referring to Table 1, when a fixing temperature upon print start is equal to or higher than 70 [° C.], the fixing temperature is handled as "Hot". When a fixing temperature upon print start is lower than 70 [° C.], the fixing temperature is handled as "Cold". For example, in a state that an absolute moisture content is "High", fixing temperature upon print start is "Hot", when simplex print is to be performed on plain paper, the nip pressure of the decurling roller pair 25 is switched to the high pressure state 29*c*.

TABLE 1

| ABSOLUTE MOISTURE CONTENT | PAPER TYPE | SIMPLEX PRINT COLD | SIMPLEX PRINT HOT | DUPLEX PRINT COLD | DUPLEX PRINT HOT |
|---|---|---|---|---|---|
| LOW | PLAIN | LOW | LOW | LOW | LOW |
| | THICK | LOW | MEDIUM | LOW | LOW |
| | THIN | LOW | LOW | LOW | LOW |
| | SMOOTH | LOW | LOW | LOW | LOW |
| | GLOSS | LOW | LOW | LOW | LOW |

TABLE 1-continued

| ABSOLUTE MOISTURE CONTENT | PAPER TYPE | SIMPLEX PRINT COLD | SIMPLEX PRINT HOT | DUPLEX PRINT COLD | DUPLEX PRINT HOT |
|---|---|---|---|---|---|
| MEDIUM | PLAIN | LOW | MEDIUM | LOW | LOW |
| | THICK | MEDIUM | HIGH | LOW | MEDIUM |
| | THIN | LOW | MEDIUM | LOW | LOW |
| | SMOOTH | LOW | LOW | LOW | LOW |
| | GLOSS | LOW | LOW | LOW | LOW |
| HIGH | PLAIN | MEDIUM | HIGH | LOW | MEDIUM |
| | THICK | MEDIUM | HIGH | LOW | MEDIUM |
| | THIN | MEDIUM | HIGH | LOW | MEDIUM |
| | SMOOTH | LOW | LOW | LOW | LOW |
| | GLOSS | LOW | MEDIUM | LOW | LOW |

In a case where a user gives a print instruction by designating a paper type in advance, the CPU 104 upon print start can obtain the paper type information. Thus, a curl correction state can be determined with reference to the nip pressure selection table as illustrated on Table 1.

On the other hand, in a case where a print instruction is given in an automatic discrimination mode for discriminating a paper type by using the paper type detecting sensor 54, the CPU 104 cannot obtain paper type information until the detection operation performed by the paper type detecting sensor 54 completes.

In a case where a curl correction state is determined upon completion of the detection operation performed by the paper type detecting sensor 54 and the switching of the curl correction state is then started, the leading edge of paper P may possibly reach the decurling roller pair 25 before the switching completes. This is caused when the time period for switching the curl correction state is longer than the time period for conveying the paper P from the paper type detecting sensor 54 to the decurling roller pair 25. Table 2 illustrates switching times from one curl correction state to another curl correction state illustrated in FIG. 3B. According to this embodiment, the time for conveying paper P from the paper type detecting sensor 54 to the position 10 mm upstream of the decurling roller pair 25 is equal to 1250 [ms]. Referring to Table 2, switching the curl correction state from the low pressure state 29*a* to the high pressure state 29*c* takes 1432 [ms], which is longer than 1250 [ms] for conveying the paper P.

TABLE 2

| BEFORE → AFTER SWITCHING | SWITCHING TIME |
|---|---|
| LOW → MEDIUM | 995 [ms] |
| MEDIUM → HIGH | 965 [ms] |
| HIGH → LOW | 1120 [ms] |
| LOW → HIGH | 1432 [ms] |
| HIGH → MEDIUM | 1591 [ms] |
| MEDIUM → LOW | 1561 [ms] |

According to this embodiment, it is controlled to determine a provisional curl correction state before a detection operation performed by the paper type detecting sensor 54 completes in the automatic discrimination mode and then start switching of the curl correction state. This can increase the possibility that the switching can be performed before the leading edge of paper P reaches the decurling roller pair 25 even when it is determined based on obtained paper type information to perform switching of the curl correction state.

Provisional Curl Correction State

Figure 4:
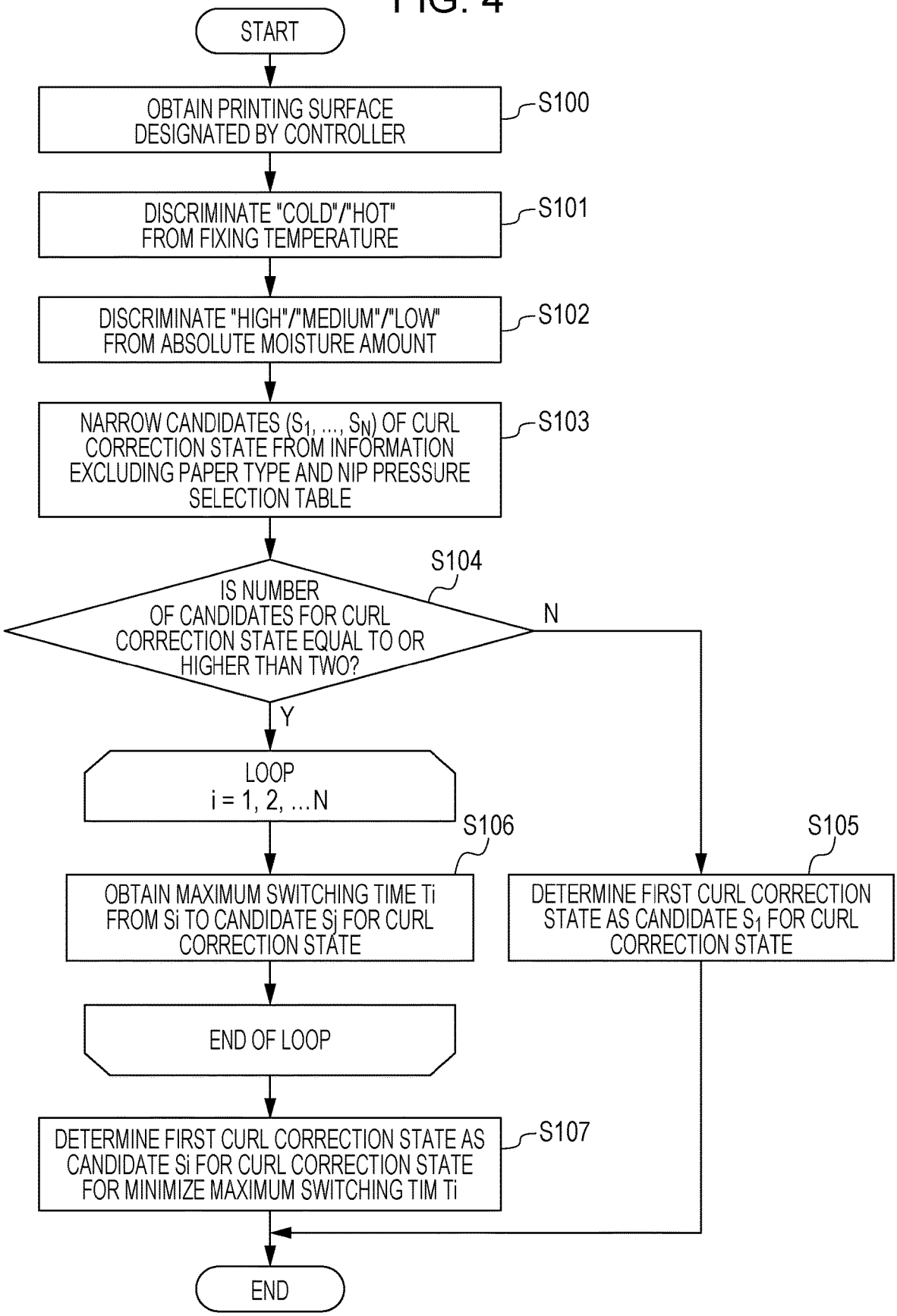
FIG. 4 is a flowchart for determining a first curl correction state.

With reference to FIG. 4 and Table 2, a method for determining a provisional curl correction state will be described. FIG. 4 is a flowchart for determining a first curl correction state based on printing side information being information excluding paper type ((information excluding property information), a fixing temperature upon print start, and an absolute moisture content). The term "first curl correction state" refers to a provisional curl correction state to be determined based on information excluding a paper type. A control based on the flowchart in FIG. 4 may be executed by the CPU 104 based on a program stored in the non-volatile memory 114, for example.

First, the CPU 104 obtains printing side information designated by the controller 102 (S100) and discriminates simplex print or duplex print to be executed. Next, the CPU 104 obtains a fixing temperature upon print start from the temperature sensor 31 and discriminates "Hot" or "Cold" (S101). Next, the CPU 104 obtains an absolute moisture content from the environmental sensor 60 and discriminates "High", "Medium", or "Low" (S102).

The CPU 104 then narrows candidates for the curl correction state for switching the nip pressure of the decurling roller pair 25 based on the information excluding a paper type (printing side information, the fixing temperature upon print start, and the absolute moisture content) and the nip pressure selection table (S103). Hereinafter, candidate states are represented by ($S_1$, $S_2$, . . . $S_N$). For example, in a case where simplex print is to be executed under conditions including "High" as an absolute moisture content and "Cold" as a fixing temperature upon print start, candidates for the curl correction state include the low pressure state 29*a* and the medium pressure state 29*b* within the intersection of the "Cold" column and "High" row in Table 1.

If it is determined that there is one candidate for the curl correction state (S104), the CPU 104 determines the candidate curl correction state $S_1$ as the first curl correction state (S105). On the other hand, if it is determined that there are two or three curl correction state candidates (S104), the CPU 104 obtains a maximum switching time Ti for each of the curl correction state candidates ($S_1$, $S_2$, . . . $S_N$) (S106). Here, the term "maximum switching time Ti" refers to a maximum value of a time period for switching from a curl correction state candidate Si to another curl correction state candidate Sj. The CPU 104 determines a curl correction state Si for minimizing the maximum switching time Ti as the first curl correction state (S107).

For example, in a case where the low pressure state 29*a* and the medium pressure state 29*b* within the intersection of the "Cold" column and "High" row on Table 1 are curl correction state candidates, the switching time from the low pressure state 29*a* to the medium pressure state 29*b* is equal to 995 [ms], and the switching time from the medium pressure state 29*b* to the low pressure state 29*a* is equal to 1561 [ms]. Here, defining that i=1 is the low pressure state 29*a* and *i*=2 is the medium pressure state 29*b*, there are only two curl correction state candidates. Therefore, the maximum switching time T1=995 [ms], and the maximum switching time T2=1561 [ms]. Because the curl correction state for minimizing the maximum switching time Ti is the low pressure state 29*a* with i=1, the CPU 104 determines the low pressure state 29*a* as the first curl correction state.

Curl Correction Operation

Figure 5:
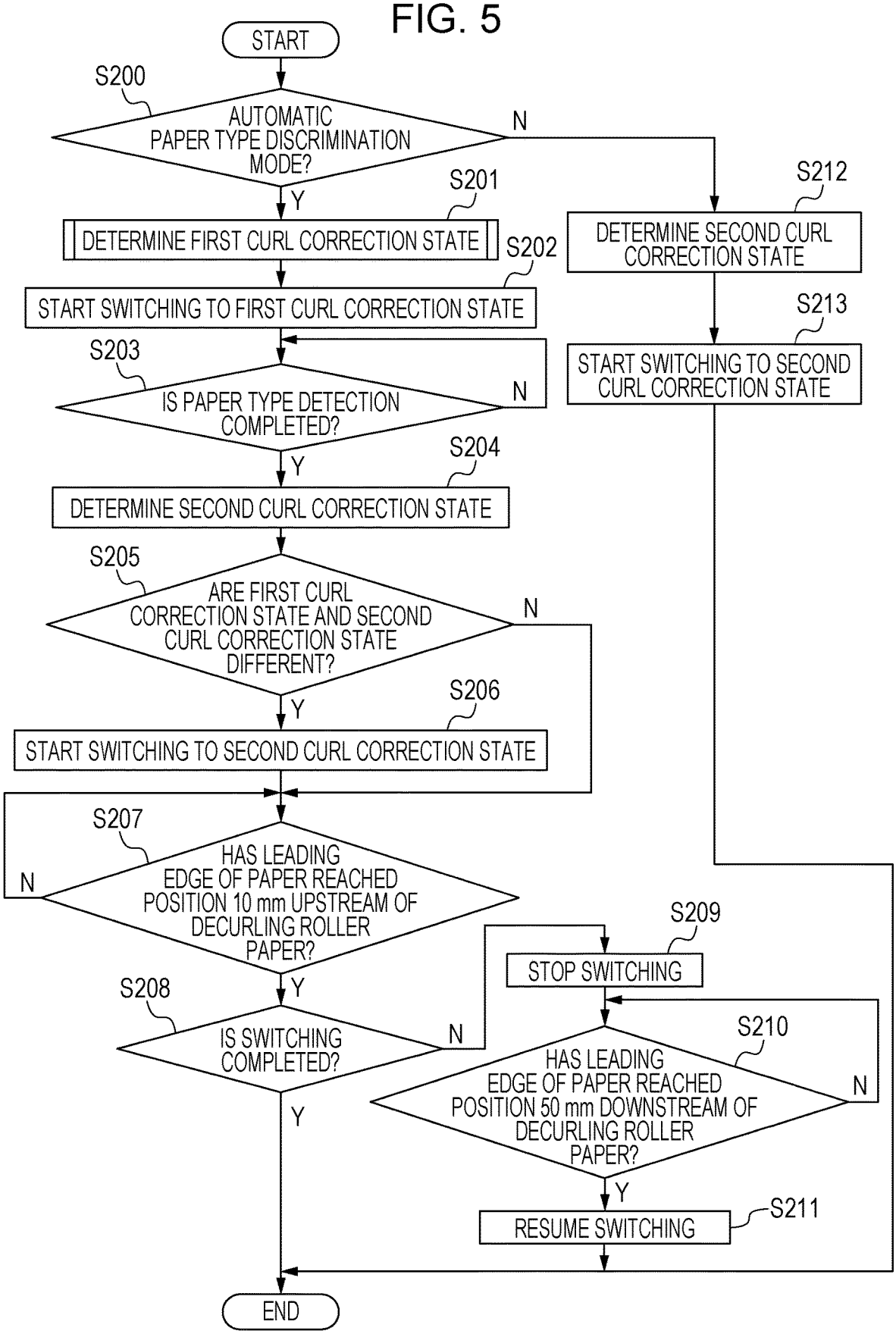
FIG. 5 is a flowchart for determining a curl correction state according to a first embodiment.

With reference to FIG. 5, a method according to this embodiment will be described which determines a curl correction state in response to a print instruction from the controller 102. A flowchart in FIG. 5 is to be executed on a first piece of paper P to be printed. In a case where the second and subsequent pieces of paper P have the same paper type as that of the first piece of paper P in a continuous printing operation, the nip pressure determined for the first piece of paper P is used for executing a curl correction operation. A control based on the flowchart in FIG. 5 may be executed by the CPU 104 based on a program stored in the non-volatile memory 114.

First, the CPU 104 determines which of a print instruction in the automatic discrimination mode from the controller 102 or a print instruction designating a paper type has been received (S200). If it is determined that a print instruction in the automatic discrimination mode has been received, the CPU 104 determines the first curl correction state as a provisional curl correction state according to the method described with reference to FIG. 4 (S201). The CPU 104 then starts a control for switching the nip pressure of the decurling roller pair 25 to the determined first curl correction state (S202). In parallel with this processing paper P is fed from the cassette 13, and the paper type detecting sensor 54 starts the detection operation on the paper P. Here, the CPU 104 switches the nip pressure of the decurling roller pair 25 to the first curl correction state before the paper type detecting sensor 54 at least completes the detection operation.

Next, the CPU 104 determines whether the paper type detecting sensor 54 completes the detection operation or not (S203). If it is determined that the detection operation has completed, the CPU 104 discriminates the paper type based on the detected property information and determines a second curl correction state based on the information including the paper type (S204). The term "second curl correction state" refers to a final curl correction state to be determined based on four kinds of information of printing side information, a fixing temperature upon print start, an absolute moisture content, and paper type information. The CPU 104 determines whether the first curl correction state and the second curl correction state are different or not (S205). If it is determined that the first curl correction state and the second curl correction state are different, the CPU 104 starts a control for switching the nip pressure of the decurling roller pair 25 to the determined second curl correction state (S206). On the other hand, if the first curl correction state and the second curl correction state are not different, that is, if the switching of the nip pressure is not necessary, the processing advances without performing the operation in S206.

When the paper type detecting sensor 54 detects the property information regarding paper P, the registration roller pair 16 is stopped, and the paper P is therefore stopped. When the registration roller pair 16 is driven again, the paper P is conveyed again toward the secondary transfer roller 11 in synchronization with toner images on the intermediate transfer belt 8. According to this embodiment, in order to prevent the reach of the leading edge of paper P to the decurling roller pair 25 before completion of the switching of the nip pressure of the decurling roller pair 25, the CPU 104 executes the following control flow.

In S207, the CPU 104 determines whether the leading edge of paper P has reached the position 10 mm upstream of the decurling roller pair 25 or not based on the time when the fixing/discharge sensor 17S detects the leading edge of the paper P. If it is determined that the leading edge has reached the position, the CPU 104 checks whether the switching of the nip pressure of the decurling roller pair 25 has completed (S208). If it is determined that the switching has not completed, the CPU 104 temporarily stops the switching of the nip pressure of the decurling roller pair 25 (S209). The CPU 104 determines whether the leading edge of the paper P has reached the position 50 mm downstream of the decurling roller pair 25 or not based on the time when the fixing/discharge sensor 17S detects the leading edge of the paper P (S210). If it is determined that the leading edge has reached the position, the CPU 104 resumes the switching of the nip pressure of the decurling roller pair 25 (S211). The switching operation performed on the nip pressure is temporarily stopped so that the leading edge of the paper P can be prevented from entering to the nip of the decurling roller pair 25 while the nip pressure is being switched and that the paper P can be conveyed in a stable manner.

If it is determined in S200 that a print instruction designating a paper type has been received, the CPU 104 determines the second curl correction state based on the printing side information, the fixing temperature upon print start, and the absolute moisture content as well as the already obtained paper type information (S212). The CPU 104 starts a control for switching the nip pressure of the decurling roller pair 25 to the determined second curl correction state (S213).

Figure 6:
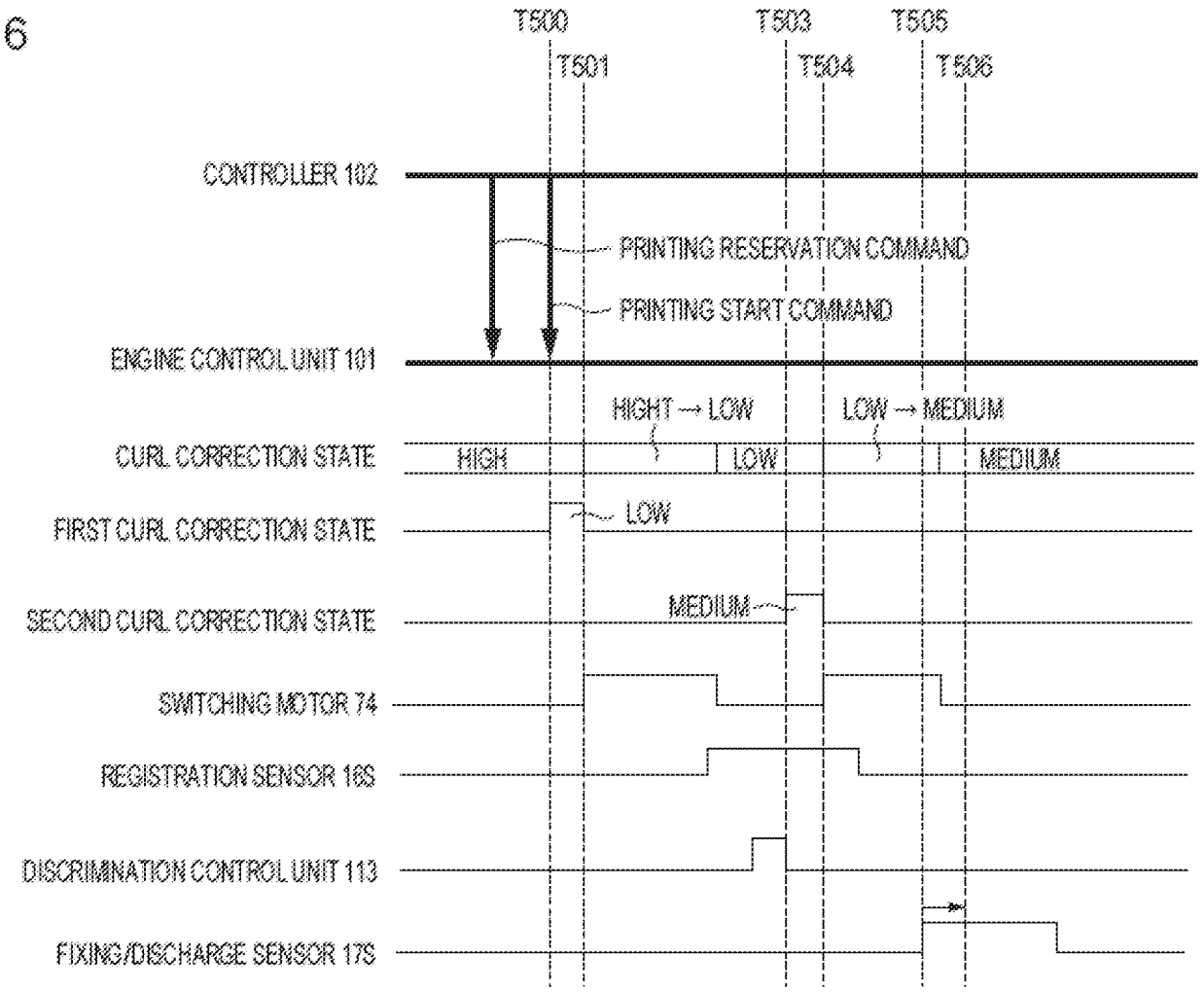
FIG. 6 is a timing chart illustrating a concrete example of the first embodiment (when switching is in time).
Figure 7:
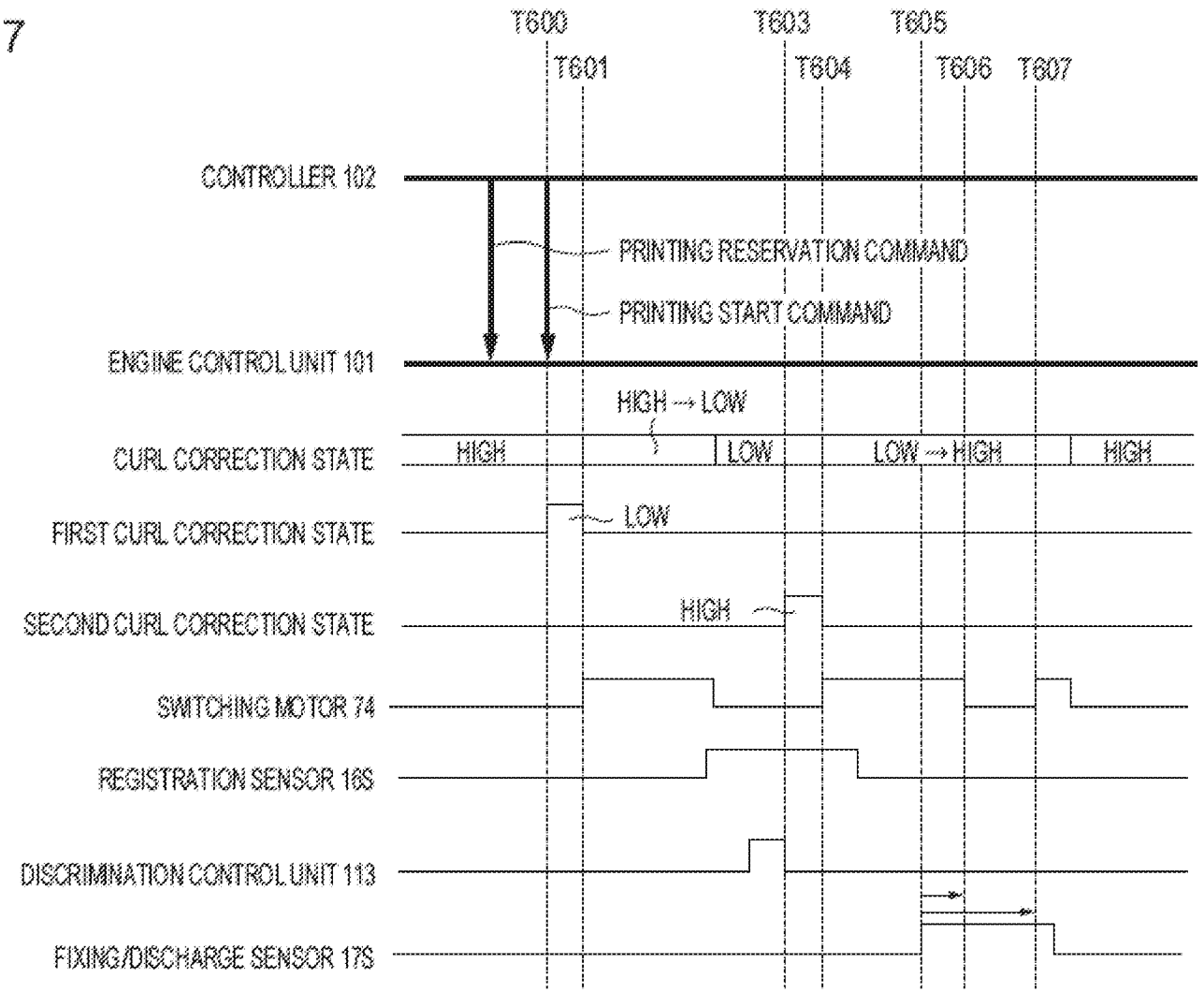
FIG. 7 is a timing chart illustrating a concrete example of the first embodiment (when switching is not in time).

Next, specific operations of this embodiment will be described with reference to the timing charts in FIGS. 6 and 7. FIG. 6 illustrates a case where the switching of the nip pressure of the decurling roller pair 25 can be performed before the leading edge of the paper P reaches the decurling roller pair 25. FIG. 7 illustrates a case where the switching of the nip pressure of the decurling roller pair 25 cannot be performed before the leading edge of the paper P reaches the decurling roller pair 25.

FIG. 6 illustrates a timing chart in a case where simplex print in the automatic discrimination mode is instructed when the absolute moisture content is "High", the fixing temperature upon print start is "Cold", and plain paper is stored in the cassette 13. Referring to FIG. 6, the initial curl correction state (initial state) is the high pressure state 29*c*. In this case, the low pressure state 29*a* is the first curl correction state, as described above. For printing on plain paper, the medium pressure state 29*b* is determined as the second curl correction state.

The engine control unit 101 in response to a print start command from the controller 102 (T500), the switching control unit 112 determines the low pressure state 29*a* as the first curl correction state and starts switching control over the nip pressure of the decurling roller pair 25 (T501). After the switching control starts, the discrimination control unit 113 discriminates plain paper as the paper type of the paper P based on a detection result from the paper type detecting sensor 54. The switching control unit 112 determines the medium pressure state 29*b* as the second curl correction state from the information including a paper type (T503) and starts the switching control over the nip pressure of the decurling roller pair 25 (T504). The engine control unit 101 obtains a time (T506) when the leading edge of the paper P reaches a position 10 mm upstream of the decurling roller pair 25 from the time (T505) when the fixing/discharge sensor 17S detects the leading edge of the paper P. Because the switching of the nip pressure of the decurling roller pair 25 ends at T506, the printing operation is continued.

FIG. 7 illustrates a timing chart in a case where simplex print in the automatic discrimination mode is instructed when the absolute moisture content is "High", the fixing temperature upon print start is "Hot", and plain paper is stored in the cassette 13. Referring to FIG. 7, the initial curl correction state (initial state) is the high pressure state 29*c*. In this case, the first curl state is the low pressure state 29*a*, and the second curl state is the high pressure state 29*c*.

The engine control unit 101 in response to a print start command from the controller 102 (T600), the switching control unit 112 determines the low pressure state 29*a* as the first curl correction state and starts switching control over the nip pressure of the decurling roller pair 25 (T601). After the switching control starts, the discrimination control unit 113 discriminates plain paper as the paper type of the paper P based on a detection result from the paper type detecting sensor 54. The switching control unit 112 determines the high pressure state 29*c* as the second curl correction state from the information including a paper type (T603) and starts the switching control over the nip pressure of the decurling roller pair 25 (T604). The engine control unit 101 obtains a time (T606) when the leading edge of the paper P reaches a position 10 mm upstream of the decurling roller pair 25 from the time (T605) when the fixing/discharge sensor 17S detects the leading edge of the paper P. Because the switching of the nip pressure of the decurling roller pair 25 has not ended at T606, the switching control unit 112 stops the switching motor 74. The switching control unit 112 drives the switching motor 74 again and resumes the switching at a time (T607) when the leading edge of the paper P reaches a position 50 mm downstream of the decurling roller pair 25.

According to this embodiment, for printing in the automatic discrimination mode, the nip pressure of the decurling roller pair 25 is switched to the first curl correction state determined from information excluding a paper type before a detection operation performed by the paper type detecting sensor 54 completes. After the detection operation performed by the paper type detecting sensor 54 completes, the nip pressure of the decurling roller pair 25 is switched to the second curl correction state determined based on the information including a paper type. Thus, an FPOT substantially equal to that of a mode in which a user designates a paper type in advance can also be realized in the automatic discrimination mode. In other words, a longer FPOT in the automatic discrimination mode can be prevented.

Further according to this embodiment, the switching of the nip pressure of the decurling roller pair 25 is temporarily stopped when the switching of the nip pressure of the decurling roller pair 25 is not performed before the leading edge of paper P reaches the nip of the decurling roller pair 25 even though the control as described above is executed. When the leading edge of the paper P reaches a position 50 mm downstream of the decurling roller pair 25, the switching of the nip pressure is resumed. The interruption of the switching of the nip pressure while a predetermined amount from the leading edge of paper P is passing through the nip can stabilize the orientation of the paper P while being conveyed, which can avoid a paper jam due to variations of the conveying path of the leading edge of the paper P.

Second Embodiment

According to the first embodiment, in a case where the switching of the nip pressure of the decurling roller pair 25 is not completed when the leading edge of the paper P reaches a position 10 mm upstream of the decurling roller pair 25, the switching is temporarily stopped. The switching is resumed when the leading edge of the paper P reaches a position 50 mm downstream of the decurling roller pair 25 so that the paper P can be prevented from entering to the nip of the decurling roller pair 25 while the nip pressure is being switched. However, there is a possibility that a curl of the paper P may not be sufficiently corrected because appropriate pressure is not applied to the paper P during a period from a time when the paper P reaches the decurling roller pair 25 to the time when the switching completes.

According to a second embodiment, in a case where there is a possibility that the switching from the first curl correction state to the second curl correction state may not be completed when the leading edge of the paper P reaches a position 10 mm upstream of the decurling roller pair 25, the timing for image forming may be delayed. Principal parts of the descriptions are the same as those of the first embodiment, and differences from the first embodiment will be described below.

Figure 8:
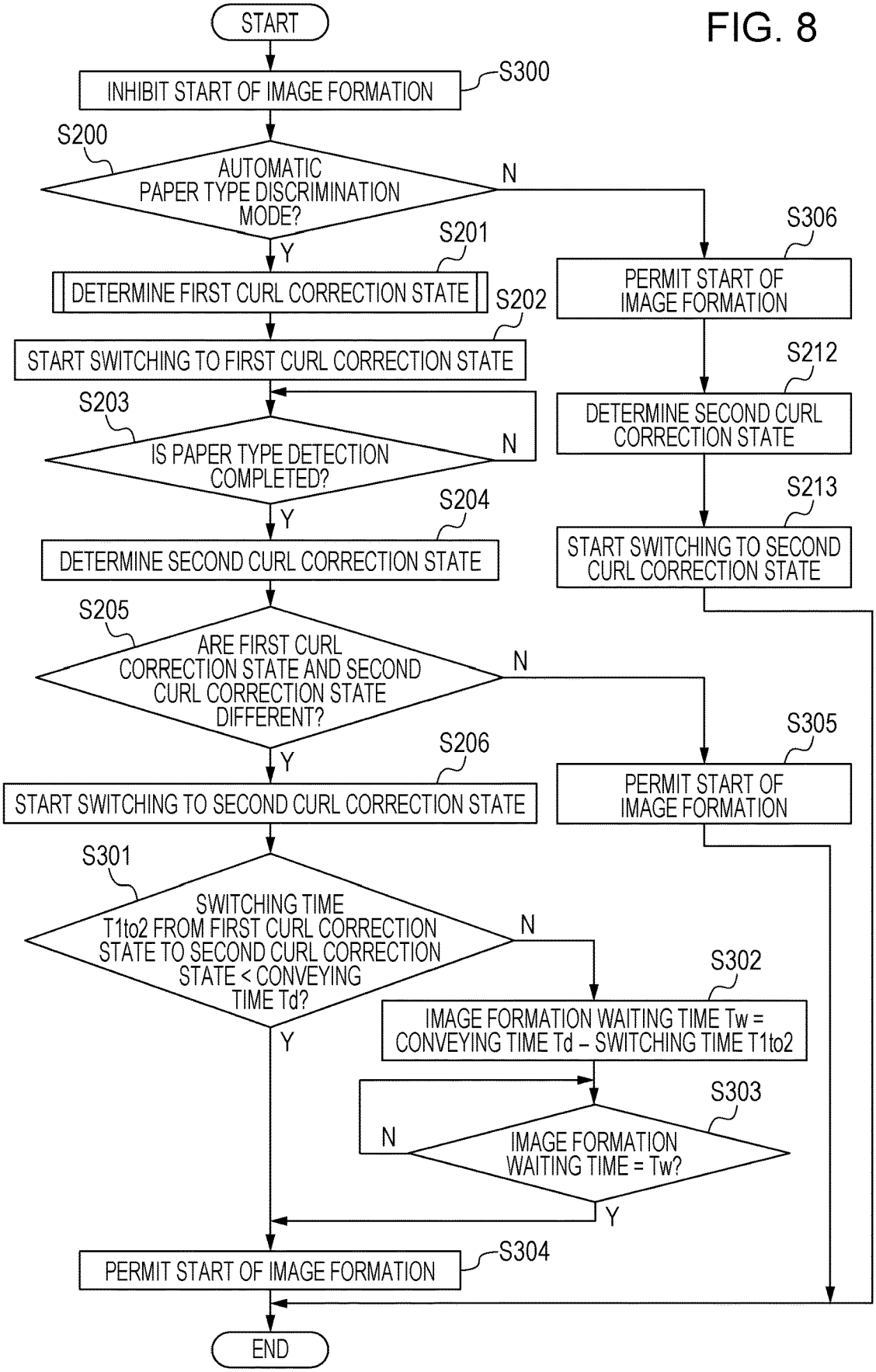
FIG. 8 is a flowchart for determining a curl correction state according to a second embodiment.

With reference to FIG. 8, a method according to this embodiment will be described which determines a curl correction state in response to a print instruction received from the controller 102. A flowchart illustrated in FIG. 8 is to be executed on a first piece of paper P to be printed. A control based on the flowchart in FIG. 8 is executed by the CPU 104 based on a program stored in the non-volatile memory 114, for example.

First, the CPU 104 in response to a print instruction from the controller 102, the image forming control unit 110 inhibits start of an image forming operation (S300). The term "image forming operation" refers to an operation for forming a toner image on the photoconductive drum 1 or the intermediate transfer belt 8, and the operation does not include a paper feeding operation for feeding paper P from the cassette 13. Because the processing in S200 to S206 is the same as the processing in the flowchart in FIG. 5, any repetitive descriptions will be omitted.

If it is determined in S205 that the first curl correction state and the second curl correction state are different, the CPU 104 starts a control for switching the nip pressure of the decurling roller pair 25 to the second curl correction state in S206. The CPU 104 then calculates a time T1to2 for switching from the first curl correction state to the second curl correction state. The CPU 104 reads out a conveyance time Td stored in the non-volatile memory 114, for example. The term "conveyance time Td" refers to a time period from a time when the detection operation performed by the paper type detecting sensor 54 completes and the registration roller pair 16 is driven again to convey paper P to a time when the leading edge of the paper P reaches a position 10 mm upstream of the decurling roller pair 25. The CPU 104 determines whether the conveyance time Td is longer than the calculated switching time T1to2 or not (S301).

If the CPU 104 determines in S301 that the conveyance time Td is shorter than the switching time T1to2, it is estimated that the leading edge of the paper P may reach the decurling roller pair 25 before the switching of the nip pressure of the decurling roller pair 25 completes. According to this embodiment, the timing for forming toner images on the photoconductive drums 1 and the intermediate transfer belt 8 is delayed. More specifically, the CPU 104 calculates an image-forming waiting time Tw (S302). The image-forming waiting time Tw may be calculated by using Expression (1).

$$\text{Image-forming waiting time } Tw = Td - T1\text{to}2 \quad (1)$$

This embodiment assumes that the conveyance time Td is equal to 1250 [ms]. After waiting for passage of the image-forming waiting time Tw (S303), the CPU 104 permits the image forming control unit 110 to start an image forming operation inhibited in S300 (S304). Thus, forming toner images on the photoconductive drums 1 and the intermediate transfer belt 8 is started. The registration roller pair 16 is then driven again, and the paper P stopped at the position of the paper type detecting sensor 54 is conveyed again in synchronization with the toner images formed on the intermediate transfer belt 8.

If it is determined in S301 that the conveyance time Td is longer than the switching time T1to2, the CPU 104 permits the image forming control unit 110 to start an image forming operation (S304).

If it is not determined in S205 that the first curl correction state and the second curl correction state are different, that is, if the switching of the nip pressure is not necessary, the CPU 104 permits the image forming control unit 110 to start an image forming operation (S305).

If it is determined in S200 that a print instruction designating a paper type is received, the nip pressure of the decurling roller pair 25 is changed without detecting a property state of the paper P by the paper type detecting sensor 54. Accordingly, the CPU 104 permits the image forming control unit 110 to start an image forming operation without waiting for passage of an image-forming waiting time (S306). Then, the second curl correction state is determined (S212), and a control starts for switching the nip pressure of the decurling roller pair 25 to the second curl correction state (S213).

Figure 9:
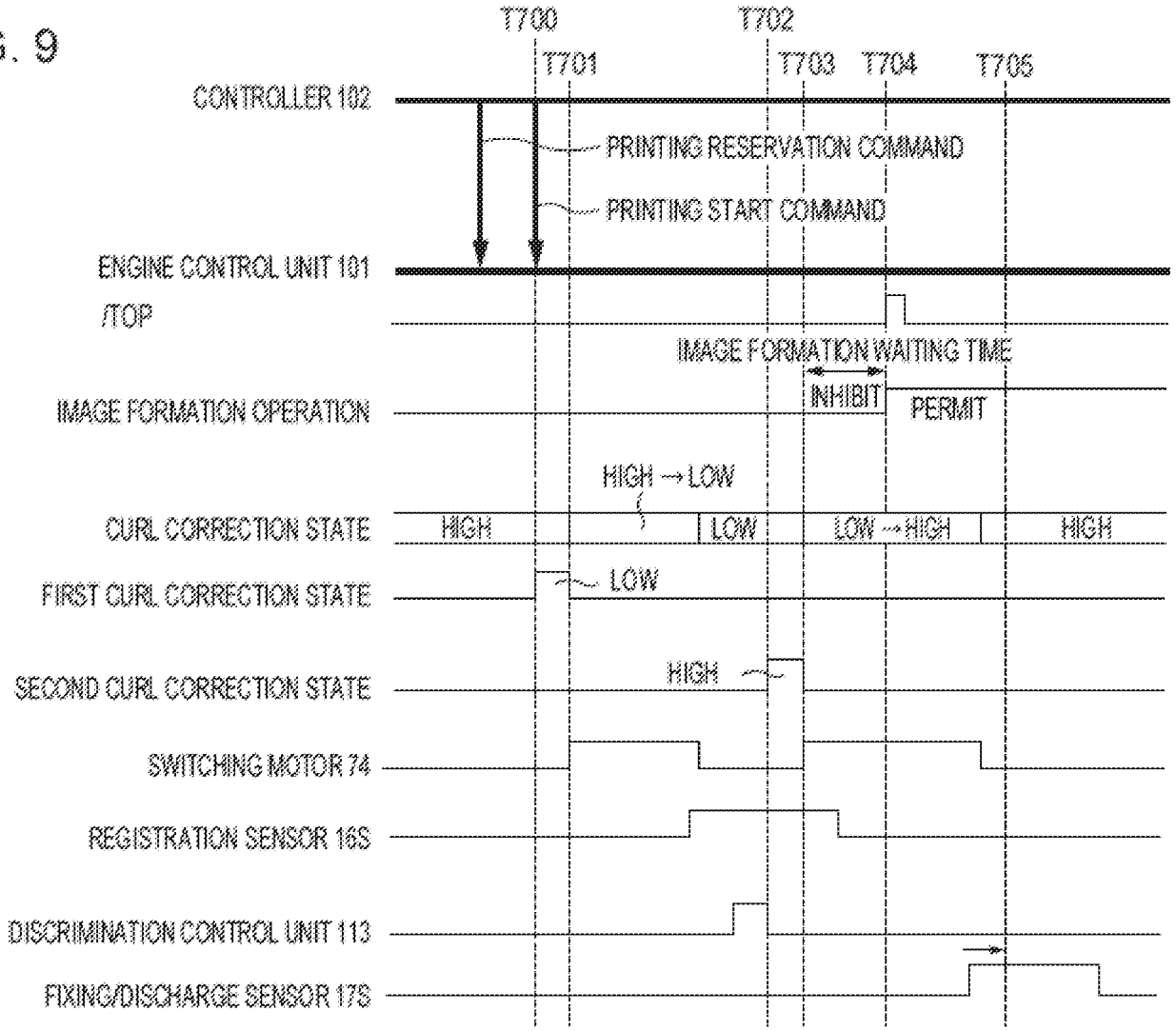
FIG. 9 is a timing chart illustrating a concrete example of the second embodiment.

Next, specific operations according to this embodiment will be described with reference to a timing chart in FIG. 9. FIG. 9 illustrates a timing chart in a case where simplex print in the automatic discrimination mode is instructed when the absolute moisture content is "High", the fixing temperature upon print start is "Hot", and the cassette 13 stores plain paper. Referring to FIG. 9, the initial curl correction state is the high pressure state 29*c*. The first curl correction state is the low pressure state 29*a*, and the second curl correction state is the high pressure state 29*c*.

The engine control unit 101 in response to a print start command from the controller 102 (T700), the switching control unit 112 determines the low pressure state 29*a* as the first curl correction state and starts switching control over the nip pressure of the decurling roller pair 25 (T701). After the switching control starts, the discrimination control unit 113 discriminates plain paper as the paper type of the paper P based on a detection result from the paper type detecting sensor 54. The switching control unit 112 determines the high pressure state 29*c* as the second curl correction state from the information including a paper type (T703) and starts the switching control over the nip pressure of the decurling roller pair 25 (T704). If the switching time T1to2 from the first curl correction state to the second curl correction state is longer than the conveyance time Td, the engine control unit 101 permits to start an image forming operation after waiting for the image-forming waiting time Tw (T704). This can delay the timing for forming toner images on the photoconductive drums 1 and the intermediate transfer belt 8 and thus can delay the timing for conveying the paper P again. By delaying the timing for conveying the paper P, the switching of the nip pressure of the decurling roller pair 25 completes at a time (T705) when the paper P reaches a position 10 mm upstream of the decurling roller pair 25.

Thus, according to this embodiment, an increase of the FPOT in the automatic discrimination mode can be prevented. Furthermore, according to this embodiment, even under the control as described above, image forming timing is delayed in a case where the switching of the nip pressure of the decurling roller pair 25 does not complete before the leading edge of the paper P reaches the decurling roller pair 25. Thus, a curl correction operation can be executed with a proper nip pressure across the entire paper P. This can reduce towards eliminating the possibility that a curl on a paper P cannot be sufficiently corrected in the first embodiment.

Third Embodiment

According to the first embodiment, before a detection operation performed by the paper type detecting sensor 54 completes, the nip pressure of the decurling roller pair 25 is switched to the first curl correction state. After the detection operation performed by the paper type detecting sensor 54 completes, the nip pressure is switched to the second curl correction state. In consideration of durability of the decurling roller pair 25, the number of times of switching of the nip pressure may be reduced. According to this embodiment, the number of times of switching of the nip pressure of the decurling roller pair 25 is reduced. Principal parts of the descriptions are the same as those of the first embodiment, and differences from the first embodiment will be described below.

First, a case will be described in which simplex print in the automatic discrimination mode is instructed when the absolute moisture content is "High", the fixing temperature upon print start is "Cold", and the cassette 13 stores thick paper. The initial curl correction state is the medium pressure state 29*b*. In this case, according to the first embodiment, candidates for a curl correction state are narrowed to the low pressure state 29*a* and the medium pressure state 29*b* based on information excluding a paper type, and the CPU 104 determines the low pressure state 29*a* as a first curl correction state. After the paper type is discriminated as thick paper, the medium pressure state 29*b* is determined as a second curl correction state. In other words, the curl correction state is switched in order of the medium pressure state 29*b*→the low pressure state 29*a*→the medium pressure state 29*b*.

Here, the number of times of switching can be reduced with a longer conveyance time Td from completion of the detection operation performed by the paper type detecting sensor 54 to reach of the leading edge of the paper P to a position 10 mm upstream of the decurling roller pair 25. A case will be examined in which the printing in the embodiment above is performed when the conveyance time Td is equal to 1600 [ms], for example. The time period for switching from the medium pressure state 29*b* being an initial curl correction state to the low pressure state 29*a* is equal to 1561 [ms] with reference to Table 2 and is shorter than the conveyance time Td. Thus, even without switching the nip pressure of the decurling roller pair 25 to the low pressure state 29*a* before the detection operation performed by the paper type detecting sensor 54 completes, the switching of the nip pressure completes before the leading edge of the paper P reaches a position 10 mm upstream of the decurling roller pair 25. In other words, even when the switching of the nip pressure of the decurling roller pair 25 starts after the detection operation performed by the paper type detecting sensor 54 completes, the switching of the nip pressure completes before the leading edge of the paper P reaches a position 10 mm upstream of the decurling roller pair 25. Therefore, in this case, the medium pressure state 29*b* is kept without provisionally switching the nip pressure to the first curl correction state (low pressure state 29*a*).

According to this embodiment, when the times for switching from an initial curl correction state to curl correction state candidates are all shorter than the conveyance time Td, the provisional switching to the first curl correction state is not executed. After the detection operation performed by the paper type detecting sensor 54 completes, switching to the second curl correction state is only executed. According to this embodiment, the printer 100 has conveying speeds for four types of paper P, and the printer 100 determines a conveying speed based on the paper type and paper size of the paper P and conveys the paper P at the determined conveying speed. Table 3 illustrates conveyance times Td corresponding to the conveying speeds.

TABLE 3

| CONVEYING SPEED | CONVEYANCE TIME |
|---|---|
| 1/1 SPEED | 1250 [ms] |
| 3/4 SPEED | 1575 [ms] |
| 1/2 SPEED | 2425 [ms] |
| 1/3 SPEED | 3585 [ms] |

Figure 10:
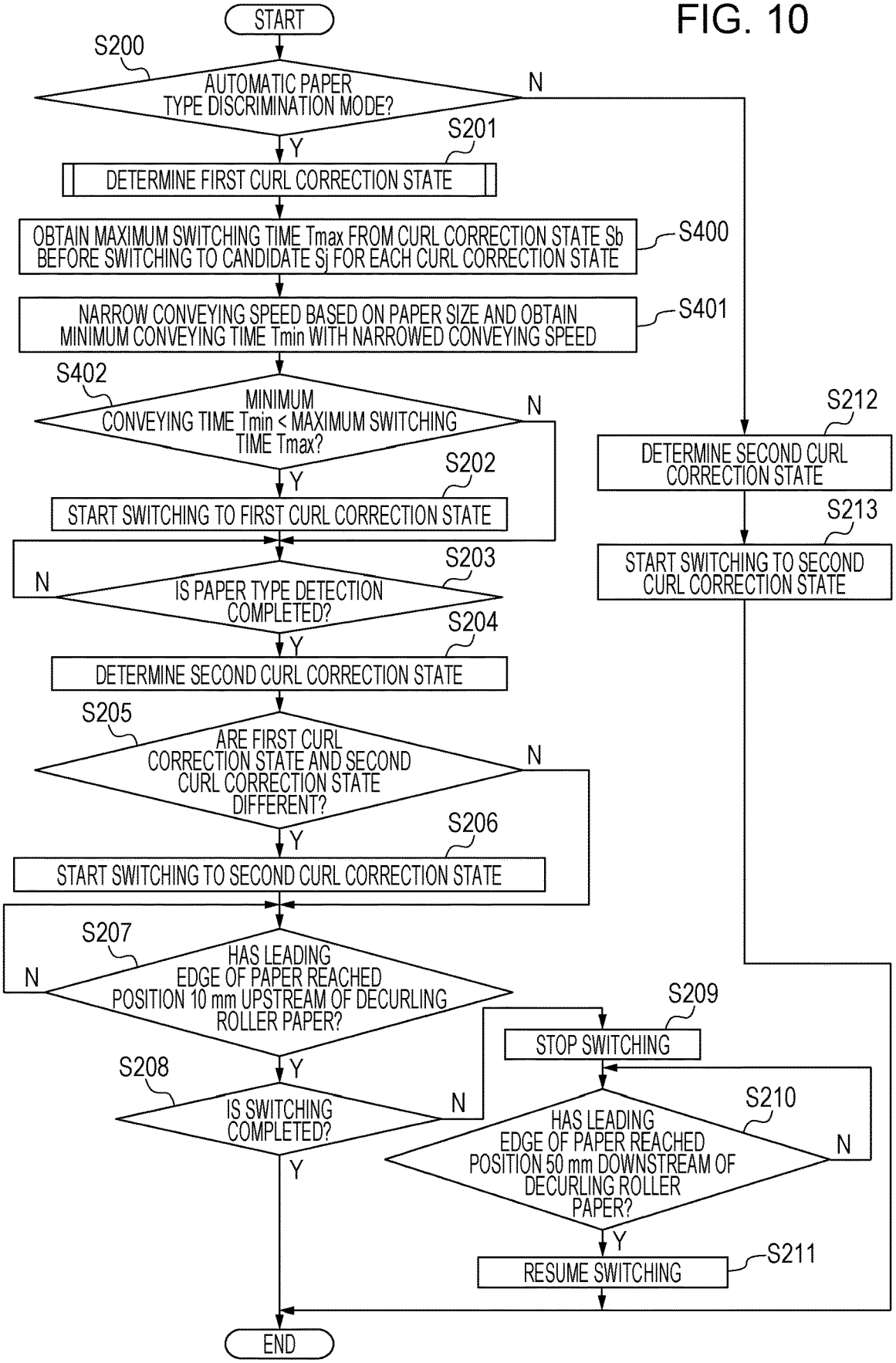
FIG. 10 is a flowchart for determining a curl correction state according to a third embodiment.

With reference to FIG. 10, a method according to this embodiment will be described which determines a curl correction state when a print instruction is received from the controller 102. The processing on the flowchart in FIG. 10 is to be executed on a first piece of paper P to be printed. A control based on the flowchart in FIG. 10 is executed by the CPU 104 based on a program stored in the non-volatile memory 114, for example.

Because the processing in S200 and S201 is the same as the processing in the flowchart in FIG. 4, any repetitive description will be omitted. After the first curl correction state is determined in S201, the CPU 104 obtains a maximum value Tmax of switching times from the curl correction state Sb before switching to curl correction state candidates Sj to be reduced in S201 (S400). The curl correction mechanism 29 has a position detecting sensor, not illustrated, and the CPU 104 can detect the curl correction state Sb before switching or the initial curl correction state. The CPU 104 reduces the conveying speeds based on the paper size of the paper P, which is notified in the print reservation command and obtains a minimum conveyance time Tmin (S401). For example, for long paper having a length of 431.9 mm in the conveying direction, the conveying speeds are reduced to one of a ¾ speed, a ½ speed, and a ⅓ speed. It may be configured such that the paper size can automatically be detected based on the position of a rear end regulating plate provided in the cassette 13.

The CPU 104 determines whether the maximum switching time Tmax is longer than the obtained minimum conveyance time Tmin or not (S402). If it is determined that the maximum switching time Tmax is longer than the minimum conveyance time Tmin, the CPU 104 starts a control for switching the nip pressure of the decurling roller pair 25 to the determined first curl correction state (S202). If it is determined that the maximum switching time Tmax is shorter than the minimum conveyance time Tmin, the CPU 104 does not perform the control for switching the nip pressure of the decurling roller pair 25 to the first curl correction state. After the paper type detecting sensor 54 completes the detection operation (S203), the CPU 104 starts a control for switching the nip pressure of the decurling roller pair 25 to the second curl correction state (S204). Because the processing in S205 to S213 is the same as the processing in the flowchart in FIG. 4 according to the first embodiment, any repetitive description will be omitted.

Figure 11:
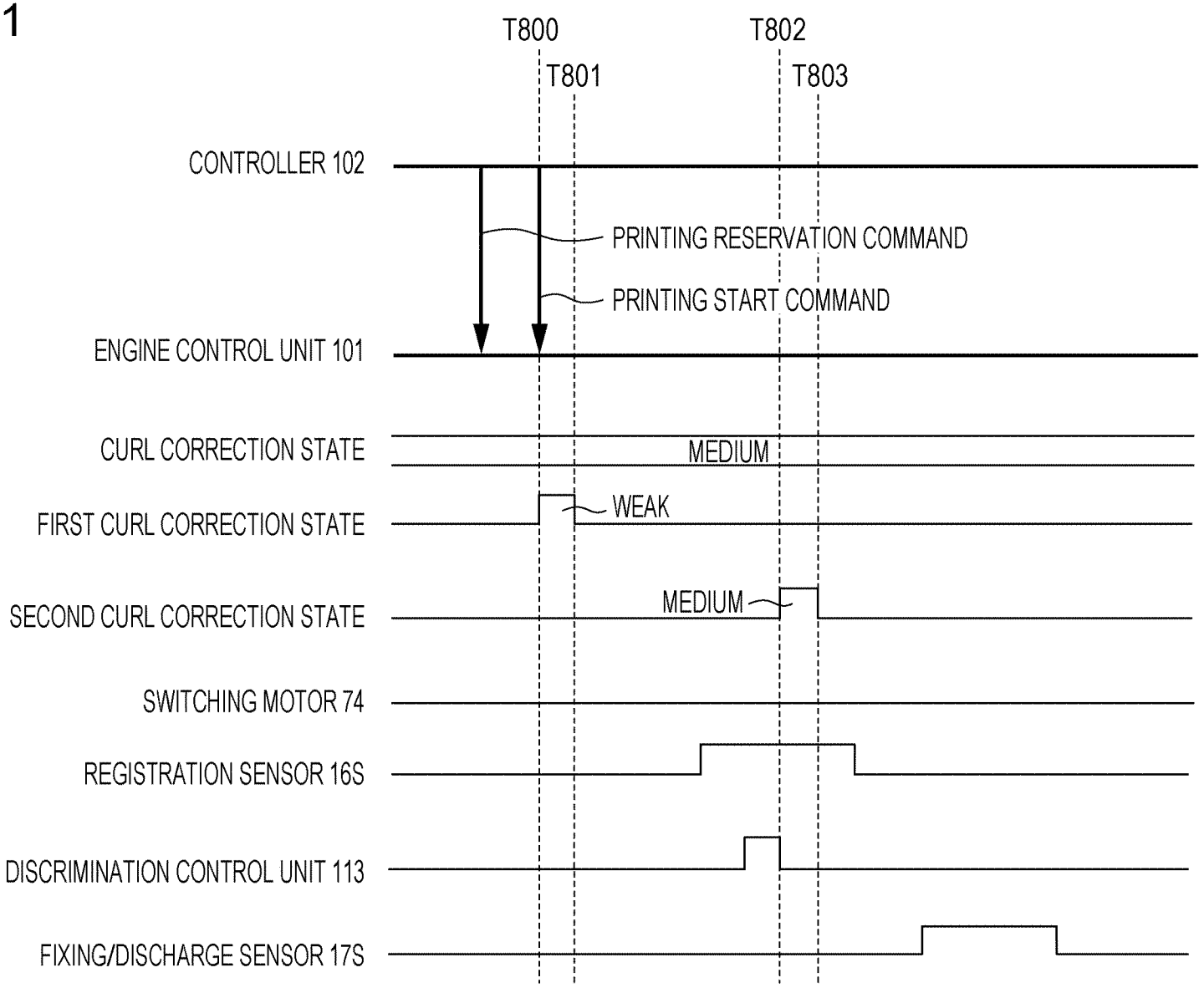
FIG. 11 is a timing chart illustrating a concrete example of the third embodiment.

Next, specific operations according to this embodiment will be described with reference to a timing chart in FIG. 11. FIG. 11 illustrates a timing chart in a case where simplex print in the automatic discrimination mode is instructed when the absolute moisture content is "High", the fixing temperature upon print start is "Cold", and the cassette 13 stores thick paper. Referring to FIG. 11, the initial curl correction state is the medium pressure state 29*b*. The conveying speed depending on the paper size is set to a ¾ speed.

When the engine control unit 101 receives a print start command from the controller 102 (T800), the switching control unit 112 narrows curl correction state candidates to the low pressure state 29*a* and the medium pressure state 29*b* and determines the low pressure state 29*a* as a first curl correction state (T801). Here, the switching time Tmax (=1561 [ms]) from the medium pressure state 29*b* being a curl correction state before switching to the low pressure state 29*a* is shorter than the minimum conveyance time Tmin (=1575 [ms]). Accordingly, the control is not executed for switching the nip pressure of the decurling roller pair 25 to the first curl correction state. The discrimination control unit 113 then discriminates thick paper as the paper type of paper P based on a detection result from the paper type detecting sensor 54. The switching control unit 112 determinates the medium pressure state 29*b* as a second curl correction state based on information including the paper type (T803). Here, because the curl correction state is the medium pressure state 29*b*, the switching control ends, and the printing operation continues.

Thus, according to this embodiment, an increase of the FPOT in the automatic discrimination mode can be prevented. Furthermore, according to this embodiment, in a case where the switching times from a curl correction state before switching to curl correction state candidates are all shorter than the conveyance time Td, switching to a provisional first curl correction state is not executed. The switching to the final second curl correction state is only executed so that the number of times of switching of the curl correction state can be reduced and that the lifetime of the decurling roller pair 25 can be increased.

Fourth Embodiment

According to the first and second embodiments, the nip pressure of the decurling roller pair 25 is provisionally switched to a first curl correction state before the paper type detecting sensor 54 completes a detection operation. After the paper type detecting sensor 54 completes the detection operation, the nip pressure is switched to a final second curl correction state. Even when the nip pressure is switched to the first curl correction state in advance, the switching to the second curl correction state may not complete before the leading edge of the paper P reaches the decurling roller pair 25, as described above. In this case, the first curl correction state may be determined again by using history of past paper type detection results. This is because, in a case where one paper feeding port (cassette) is selected in continuously executed printing operation, there is a high possibility that paper P of the same paper type is fed from the paper feeding port.

Figure 12:
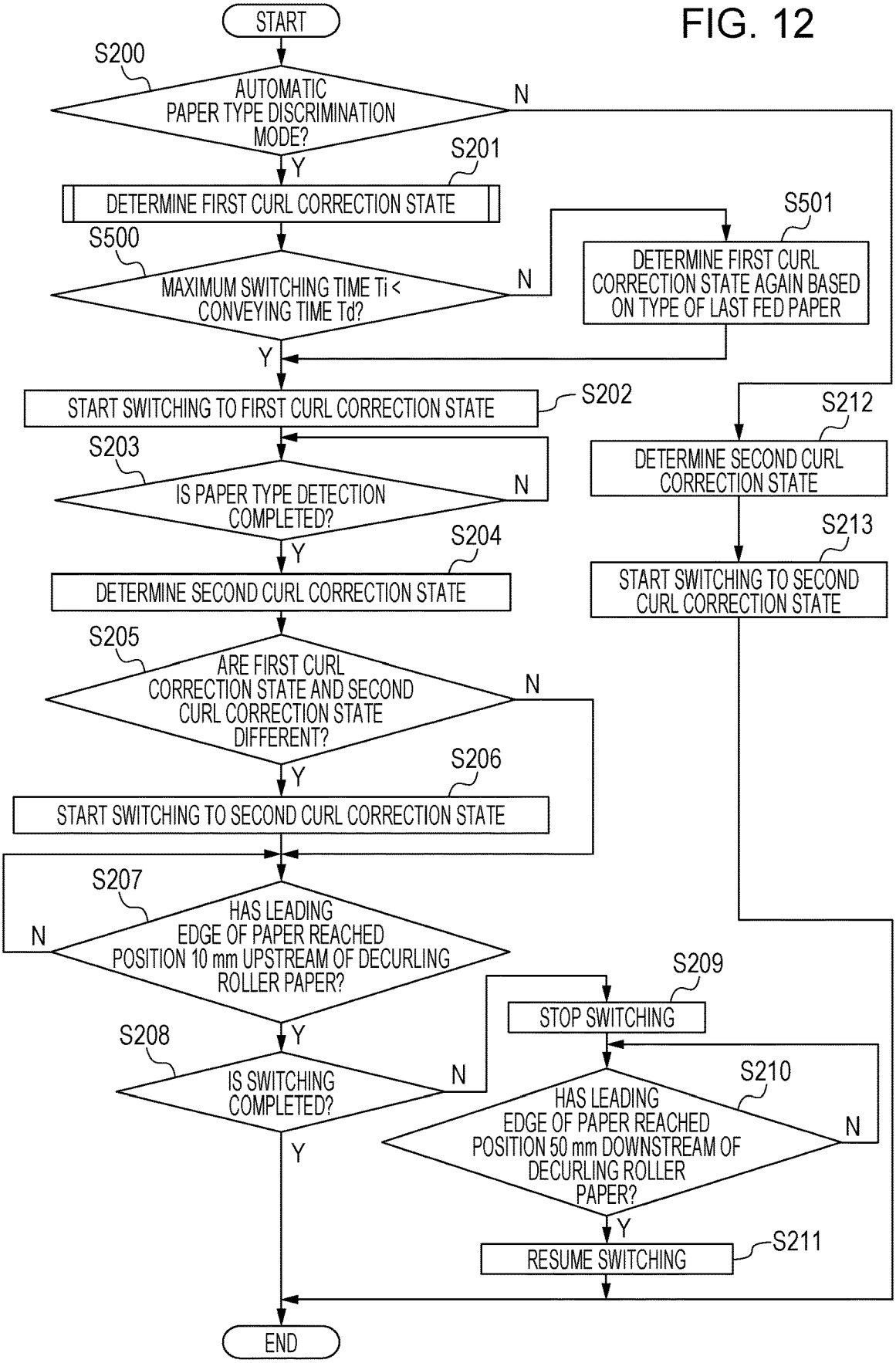
FIG. 12 is a flowchart for determining a curl correction state according to a variation example.

FIG. 12 is a flowchart illustrating the control. FIG. 12 is fundamentally the same as the flowchart illustrated in FIG. 5 according to the first embodiment and is different from the flowchart in FIG. 5 in that processing in S500 and S501. The non-volatile memory 114 illustrated in FIG. 2 stores information indicating a paper type of paper P fed from the feeding/conveying device 12 in the last print operation.

After the first curl correction state is determined in S201, the CPU 104 obtains a maximum value Ti of times for switching from the first curl correction state to another curl correction state candidates. The CPU 104 then reads out the conveyance time Td stored in the non-volatile memory 114, for example. The CPU 104 determines whether the conveyance time Td is longer than the maximum switching time Ti (S500). If it is determined that the conveyance time Td is shorter than the maximum switching time Ti, it is determined that paper of the same paper type as the paper type lastly fed from feeding/conveying device 12 is to be conveyed. Then, the CPU 104 determines again the first curl correction state based on the information indicating the lastly fed paper type (S501). The information indicating the paper type of lastly fed paper is stored in the non-volatile memory 114. The CPU 104 then starts a control for switching the nip pressure of the decurling roller pair 25 to the determined first curl correction state (S202).

Thus, if the paper type detected by the paper type detecting sensor 54 is the same as the paper type of the lastly fed paper, the first curl correction state determined based on the paper type of the lastly fed paper is identical to the final second curl correction state. This works towards eliminating necessity for the operation for switching the nip pressure of the decurling roller pair 25 and can prevent inconvenience in which the switching to the second curl correction state cannot be completed before the leading edge of the paper P reaches the decurling roller pair 25.

Variation Examples

Figure 13:
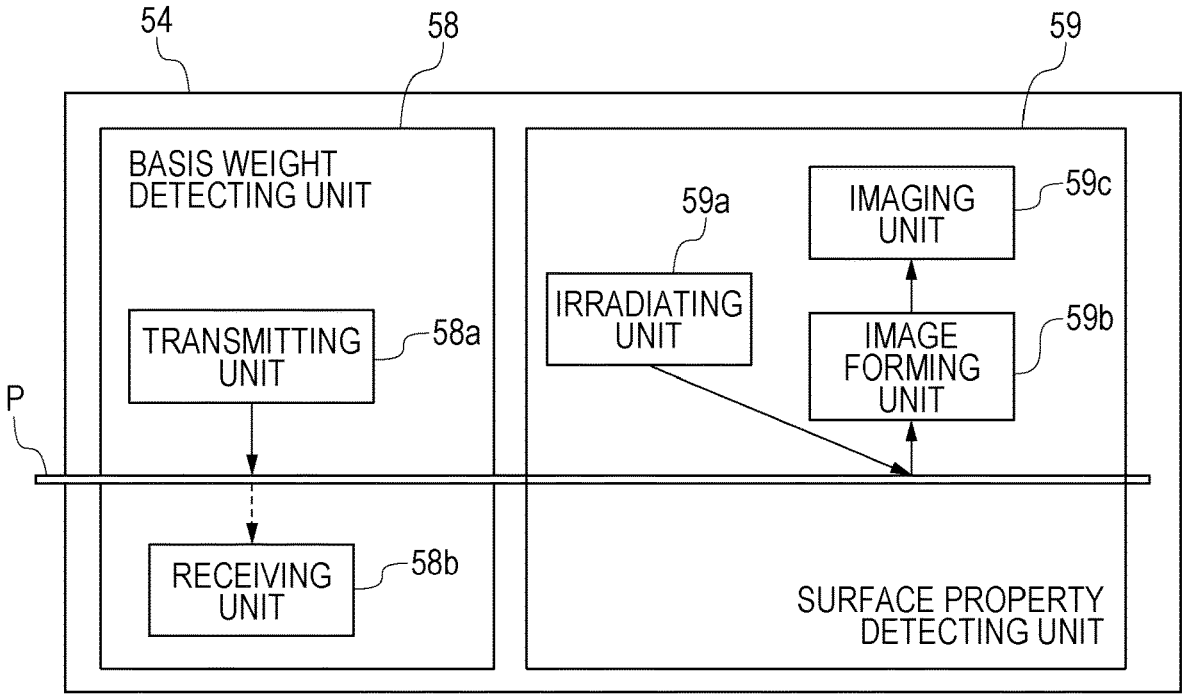
FIG. 13 is a schematic diagram illustrating a configuration of a paper type detecting sensor according to the variation example.

Having described that, according to the first to third embodiments, the paper type detecting sensor 54 is configured to detect reflected light and transmitted light. However, embodiments are not limited thereto. For example, a paper type detecting sensor 54 may be applied which has an ultrasonic wave detecting unit 58 and a surface property detection unit 59 as illustrated in FIG. 13. In the ultrasonic wave detecting unit 58, ultrasonic waves are transmitted from a transmitting unit 58*a*, ultrasonic waves attenuated through paper P are received by a receiving unit 58*b*. The CPU 104 detects a basis weight of the paper P as property information based on the amplitude value of the ultrasonic waves received by the receiving unit 58*b*. The surface property detection unit 59 includes an irradiating unit 59*a*, a focusing unit 59*b*, and an image capturing unit 59*c*. The irradiating unit 59*a* is configured to irradiate light to paper P, and the focusing unit 59*b* is configured to focus light reflected by a surface of the paper P. The image capturing unit 59*c* is a light receiving unit configured to receive light focused by the focusing unit 59*b* and captures a surface image of the paper P from the received light. The CPU 104 then detects surface a property (unevenness) of the paper P as property information based on the surface image captured by the image capturing unit 59*c*. The discrimination control unit 113 discriminates a paper type based on the detected basis weight and surface property.

According to the first to third embodiments, the nip pressure of the decurling roller pair 25 included in the curl correction mechanism 29 is switched. However, the embodiments are not limited thereto.

For example, the disclosed information is also applicable to the fixing device 17 configured to fix toner images to paper P. The fixability of toner images to paper P may depend on the nip pressure in fixing processing and may also depend on environmental conditions and the paper type of paper P. Therefore, a fixing nip pressure for optimum fixability may be set in consideration of a paper type, for example. Accordingly, the nip pressure to be applied in fixing processing may be changed based on a paper type detection result from the paper type detecting sensor 54, like the aforementioned embodiments.

Figure 14:
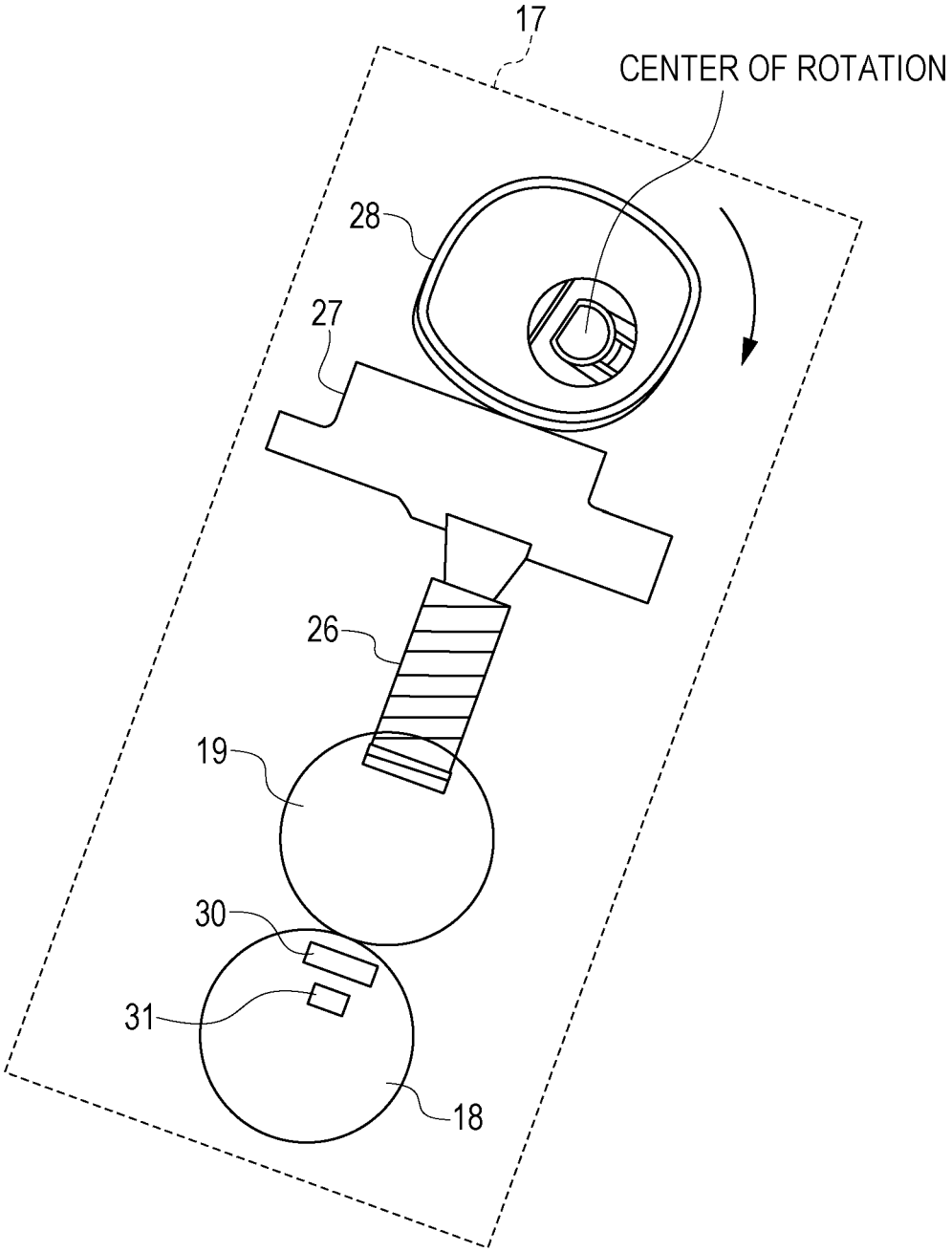
FIG. 14 is a schematic diagram illustrating a configuration of a fixing device according to the variation example.

In other words, it may be configured such that the nip pressure between the fixing film 18 and the pressurizing roller 19 included in the fixing device 17 illustrated in FIG. 1 can be switched, and the present embodiment may be applied to the switching of the nip pressure. FIG. 14 illustrates a configuration of the fixing device 17 which can switch the nip pressure between the fixing film 18 and the pressurizing roller 19. The fundamental configuration is the same as that of the curl correction mechanism 29 illustrated in FIG. 3. Referring to FIG. 14, when the switching motor 74 is driven, the pressure control cam 28 rotates in a direction indicated by arrow illustrated in FIG. 14. The pressure control cam 28 switches the pressure applied from the pressurizing roller 19 to the fixing film 18 through the pressure lever 27 and the pressurizing spring 26.

It is assumed here that the switching control over the pressure applied from the pressurizing roller 19 to the fixing film 18 is equivalent to the switching control over the curl correction state in the curl correction operation as described above. This allows fixing toner images to paper P with a fixing nip pressure suitable for the paper type without increasing an FPOT in that case.

Having described that, according to the first to third embodiments, the nip pressure can be switched in three levels, embodiments are not limited thereto. The nip pressure may only be required to be switched in at least two levels.

Having described laser beam printers according to the aforementioned embodiments as examples, the examples are not limited thereto. An embodiment is also applicable to a printer or a copier of other printing systems such as an ink-jet printer.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-233352 filed Nov. 30, 2016, which is hereby incorporated by reference herein in its entirety.

What is claimed is:

1. An image forming apparatus comprising:

a feeding unit configured to feed a recording material placed on a plate;

an image forming unit configured to form an image on the recording material;

a conveying unit including a first rotating member and a second rotating member, wherein the conveying unit is configured to convey the recording material and to apply a nip pressure from a nip portion formed by the first rotating member and the second rotating member;

a switching unit configured to switch the nip pressure between at least three levels;

a detecting unit provided between the feeding unit and the conveying unit and configured to detect property information regarding the recording material; and a control unit configured to control the switching unit, wherein, in response to an instruction to form the image on the recording material and before detection of property information regarding the recording material by the detecting unit is completed, the control unit is configured to control the switching unit to switch the nip pressure based on information regarding image forming on the recording material, and wherein, in response to the instruction to form the image on the recording material and after detection of the property information regarding the recording material by the detecting unit is completed, the control unit is configured to control the switching unit to switch the nip pressure based on the information regarding the image forming on the recording material and the property information detected by the detecting unit.

2. The image forming apparatus according to claim 1, wherein the switching unit further is configured to switch the nip pressure in one direction.

3. The image forming apparatus according to claim 2, wherein the control unit further is configured to select a candidate state to be obtained by switching the nip pressure based on the information regarding the image forming on the recording material, wherein, in a case where there is only one candidate state, the control unit determines the candidate state as a first state, and wherein, in a case where there are two candidate states, the control unit obtains a maximum time for switching from a predetermined candidate state to a candidate state different from the predetermined candidate state and determines a candidate state providing the maximum time as the first state.

4. The image forming apparatus according to claim 3, further comprising a storage unit configured to store property information regarding a past recording material fed by the feeding unit in the past, wherein the control unit is configured to obtain a maximum time for switching from the first state based on the information regarding the image forming on the recording material to a candidate state different from the first state, and wherein, in a case where it is determined that a time interval between a time of completion of detection of the property information regarding the recording material by the detecting unit and a time when a leading edge of the recording material reaches the conveying unit is shorter than the maximum time, the control unit is configured to determine the first state based on the information regarding the image forming on the recording material and the property information regarding the recording material stored in the storage unit.

5. The image forming apparatus according to claim 3, wherein the control unit is configured to control the switching unit to switch the nip pressure to the first state before detection of property information regarding the recording material by the detecting unit is completed, wherein the control unit is configured to determine a second state based on information regarding the image forming on the recording material and the property information after the detection of the property information regarding the recording material by the detecting unit is completed, and wherein, in a case where the first state and the second state are different, the control unit is configured to control the switching unit to switch the nip pressure to the second state.

6. The image forming apparatus according to claim 5, wherein, in a case where the control unit determines that switching of the nip pressure to the second state will not complete before a time when a leading edge of the recording material reaches the conveying unit, the control unit discontinues switching of the nip pressure by the switching unit before the time and resumes the switching of the nip pressure by the switching unit after the time.

7. The image forming apparatus according to claim 5, wherein the image forming unit includes an image bearing member and a transfer unit configured to transfer a toner image formed on the image bearing member to the recording material, wherein the detecting unit is provided between the feeding unit and the transfer unit, and wherein, in a case where the control unit determines that the nip pressure will not be switched to the second state before a time when a leading edge of the recording material reaches the conveying unit, the control unit delays forming of a toner image on the image bearing member by the image forming unit and delays conveyance of the recording material to the conveying unit.

8. The image forming apparatus according to claim 3, wherein the control unit is configured to obtain a maximum time for switching from an initial state of the nip pressure to the candidate states, wherein, in a case where it is determined that a time interval between a time of completion of detection of property information regarding a recording material by the detecting unit and a time when a leading edge of the recording material reaches the conveying unit is longer than the maximum time, the control unit does not switch the nip pressure to the first state, and wherein, after detection of property information regarding the recording material by the detecting unit, the control unit determines a second state based on information excluding the property information and the property information and controls the switching unit to switch the nip pressure to the second state.

9. The image forming apparatus according to claim 1, wherein the conveying unit is a fixing unit configured to fix an image formed by the image forming unit on the recording material.

10. The image forming apparatus according to claim 1, further comprising a fixing unit configured to fix an image formed by the image forming unit to the recording material, wherein the conveying unit is a curl correction mechanism configured to correct a curl formed by the fixing unit on the recording material.

11. The image forming apparatus according to claim 10, further comprising at least one of a temperature sensor configured to detect a temperature of the fixing unit and an environmental sensor configured to detect an ambient temperature or humidity of the image forming apparatus, wherein, before detection of the recording material by the detecting unit is completed, the control unit controls the switching unit to switch the nip pressure based on at least one of three pieces of information of a data set consisting of an indication whether an image or images are to be formed on one side or both sides of the recording material by the image forming unit, a detection result from the temperature sensor, and a detection result from the environmental sensor, and wherein, after the detection of the recording material by the detecting unit is completed, the control unit controls the switching unit to switch the nip pressure based on the property information detected by the detecting unit in addition to the at least one of the three pieces of information.

12. The image forming apparatus according to claim 1, wherein the detecting unit includes an irradiating unit configured to irradiate light to the recording material, a first light receiving unit configured to receive light irradiated by the irradiating unit and reflected by the recording material, and a second light receiving unit configured to receive light irradiated by the irradiating unit and transmitted through the recording material, and wherein the detecting unit is configured to detect a surface property of the recording material as the property information from an amount of reflected light received by the first light receiving unit and detect thickness of the recording material as the property information from the amount of transmitted light received by the second light receiving unit.

13. The image forming apparatus according to claim 1, wherein the detecting unit includes a transmitting unit configured to transmit ultrasonic waves to the recording material, a receiving unit configured to receive ultrasonic waves transmitted by the transmitting unit and attenuated through the recording material, an irradiating unit configured to irradiate light to the recording material, and an image capturing unit configured to capture an image of light irradiated by the irradiating unit and reflected by the recording material, and wherein the detecting unit is configured to detect a basis weight of the recording material as the property information from ultrasonic waves received by the receiving unit, and to detect a surface property of the recording material as the property information from a surface image captured by the image capturing unit.

14. An image forming apparatus comprising:

a feeding unit configured to feed a recording material placed on a plate;

an image forming unit configured to form an image on the recording material;

a conveying unit including a first rotating member and a second rotating member, wherein the conveying unit is configured to convey the recording material and to apply a nip pressure from a nip portion formed by the first rotating member and the second rotating member;

a switching unit configured to switch the nip pressure between at least three levels;

a detecting unit provided between the feeding unit and the conveying unit and configured to detect property information regarding the recording material; and a control unit configured to, in response to an instruction to form the image on the recording material, control the switching unit to switch the nip pressure to a first state based on information regarding image forming on the recording material before detection of property information regarding the recording material by the detecting unit is completed, and determine a second state of the nip pressure based on information regarding image forming on the recording material and the property information detected by the detecting unit after detection of property information regarding the recording material by the detecting unit is completed, wherein, in a case where the first state and the second state are identical, the control unit controls the switching unit not to switch the nip pressure from the first state, and wherein, in a case where the first state and the second state are different, the control unit controls the switching unit to switch the nip pressure to the second state.

15. The image forming apparatus according to claim 14, further comprising a fixing unit configured to fix an image formed by the image forming unit to the recording material, wherein the conveying unit is a curl correction mechanism configured to correct a curl formed by the fixing unit on the recording material.

16. The image forming apparatus according to claim 15, further comprising at least one of a temperature sensor configured to detect a temperature of the fixing unit and an environmental sensor configured to detect an ambient temperature or humidity of the image forming apparatus, wherein, before detection of the recording material by the detecting unit is completed, the control unit controls the switching unit to switch the nip pressure based on at least one of three pieces of information of a data set including an indication whether an image or images are to be formed on one side or both sides of the recording material by the image forming unit, a detection result from the temperature sensor, and a detection result from the environmental sensor, and wherein, after the detection of the recording material by the detecting unit is completed, the control unit controls the switching unit to switch the nip pressure based on the property information detected by the detecting unit in addition to the at least one of the three pieces of information.

17. The image forming apparatus according to claim 14, wherein the detecting unit includes a transmitting unit configured to transmit ultrasonic waves to the recording material, a receiving unit configured to receive ultrasonic waves transmitted by the transmitting unit and attenuated through the recording material, an irradiating unit configured to irradiate light to the recording material, and an image capturing unit configured to capture an image of light irradiated by the irradiating unit and reflected by the recording material, and wherein the detecting unit is configured to detect a basis weight of the recording material as the property information from ultrasonic waves received by the receiving unit and detect a surface property of the recording material as the property information from a surface image captured by the image capturing unit.

18. An image forming apparatus comprising:

a feeding unit configured to feed a recording material placed on a plate;

an image forming unit configured to form an image on the recording material;

a fixing unit configured to fix an image formed by the image forming unit to the recording material;

a conveying unit including a first rotating member and a second rotating member, wherein the conveying unit is configured to convey the recording material and to apply a nip pressure from a nip portion formed by the first rotating member and the second rotating member, and wherein the conveying unit is a curl correction mechanism configured to correct a curl formed by the fixing unit on the recording material;

a switching unit configured to switch the nip pressure between at least three levels;

a detecting unit provided between the feeding unit and the conveying unit and configured to detect property information regarding the recording material; and a control unit configured to control the switching unit, wherein, in response to an instruction to form the image on the recording material and before detection of property information regarding the recording material by the detecting unit is completed, the control unit is configured to control the switching unit to switch the nip pressure, and wherein, in response to the instruction to form the image on the recording material and after detection of the property information regarding the recording material by the detecting unit is completed, the control unit is configured to control the switching unit to switch the nip pressure.

19. The image forming apparatus according to claim 18, further comprising at least one of a temperature sensor configured to detect a temperature of the fixing unit and an environmental sensor configured to detect an ambient temperature or humidity of the image forming apparatus, wherein, before detection of the recording material by the detecting unit is completed, the control unit controls the switching unit to switch the nip pressure based on at least one of three pieces of information of a data set including an indication whether an image or images are to be formed on one side or both sides of the recording material by the image forming unit, a detection result from the temperature sensor, and a detection result from the environmental sensor, and wherein, after the detection of the recording material by the detecting unit is completed, the control unit controls the switching unit to switch the nip pressure based on the property information detected by the detecting unit in addition to the at least one of the three pieces of information.

* * * * *